US009579907B2

(12) United States Patent
Shinjo et al.

(10) Patent No.: US 9,579,907 B2
(45) Date of Patent: Feb. 28, 2017

(54) PRINTING APPARATUS

(71) Applicant: CANON KABUSHIKI KAISHA, Tokyo (JP)

(72) Inventors: Ryoya Shinjo, Kawasaki (JP); Yoshiaki Suzuki, Nagareyama (JP); Tsuyoshi Mikoshiba, Yokohama (JP); Masaki Komatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/939,036

(22) Filed: Nov. 12, 2015

(65) Prior Publication Data

US 2016/0136976 A1 May 19, 2016

(30) Foreign Application Priority Data

Nov. 19, 2014 (JP) ..... 2014-234759

(51) Int. Cl.
*B41J 11/00* (2006.01)
*B41J 2/01* (2006.01)
*B41J 15/16* (2006.01)

(52) U.S. Cl.
CPC ..... *B41J 11/0045* (2013.01); *B41J 2/01* (2013.01); *B41J 15/16* (2013.01)

(58) Field of Classification Search
CPC ..... B41J 11/0045; B41J 15/16; B41J 2/01
See application file for complete search history.

(56) References Cited

U.S. PATENT DOCUMENTS

| | | | | |
|---|---|---|---|---|
| 4,855,790 | A | 8/1989 | Suzuki | |
| 4,998,121 | A | 3/1991 | Koh et al. | |
| 5,043,763 | A | 8/1991 | Koh et al. | |
| 5,923,360 | A * | 7/1999 | Mori | G03G 15/234 347/262 |
| 6,332,068 | B2 * | 12/2001 | Blackman | 355/24 |
| 7,236,736 | B2 * | 6/2007 | Konagaya | B41J 3/60 399/395 |
| 7,731,184 | B2 * | 6/2010 | Lo | B65H 15/00 271/186 |
| 9,091,992 | B2 * | 7/2015 | Tamura | G03G 15/6555 |
| 2012/0263514 | A1 | 10/2012 | Tanami et al. | |

(Continued)

FOREIGN PATENT DOCUMENTS

| | | |
|---|---|---|
| JP | 11-011750 A | 1/1999 |
| JP | 2002-348011 A | 12/2002 |

(Continued)

*Primary Examiner* — Henok Legesse
(74) *Attorney, Agent, or Firm* — Fitzpatrick, Cella, Harper & Scinto

(57) ABSTRACT

There is provided a printing apparatus having a supply function and a winding function, in which a sheet is guided to a desirable position. To achieve this, the apparatus includes: a supply unit configured to hold a plurality of rolls of a wound continuous sheet; a printing unit configured to print an image on a sheet drawn from one of the rolls held by the supply unit; a storage unit configured to store a sheet printed in the printing unit; and a guiding unit configured to guide a sheet discharged from the printing unit to the storage unit, wherein the guiding unit is capable of switching between guiding the sheet discharged from the printing unit to the storage unit and guiding the sheet discharged from the printing unit to the supply unit so that the sheet is wound.

13 Claims, 21 Drawing Sheets

(56) References Cited

U.S. PATENT DOCUMENTS

| | | | |
|---|---|---|---|
| 2014/0239113 | A1 | 8/2014 | Igarashi et al. |
| 2015/0251865 | A1 | 9/2015 | Nishida et al. |
| 2015/0256694 | A1 | 9/2015 | Suzuki et al. |
| 2015/0353307 | A1 | 12/2015 | Nishida et al. |
| 2015/0353308 | A1 | 12/2015 | Taguchi et al. |

FOREIGN PATENT DOCUMENTS

| | | | |
|---|---|---|---|
| JP | 2003-012205 | A | 1/2003 |
| JP | 2013-116561 | A | 6/2013 |

* cited by examiner

FIG.8A

| | USER'S RECOGNITION | STATE OF PRINTER (SENSOR DETECTION RESULT) | SELECTED CONTROL MODE | FOOLPROOF |
|---|---|---|---|---|
| I | WIND | POSITION DETECTION SENSOR 69 ON OR POSITION DETECTION SENSOR 67 OFF (WIND) | SUPPLY MODE | DISPLAY ON OPERATION PANEL 20 AND WARN TO USER |
| II | SUPPLY | POSITION DETECTION SENSOR 69 OFF OR POSITION DETECTION SENSOR 67 ON (SUPPLY) | WINDING MODE | DISPLAY ON OPERATION PANEL 20 AND WARN TO USER |

FIG.8B

| | USER'S RECOGNITION | STATE OF PRINTER (SENSOR DETECTION RESULT) | SELECTED CONTROL MODE | FOOLPROOF |
|---|---|---|---|---|
| I | WIND | LEADING END DETECTION SENSOR 301b OFF OR DETECT SPOOL DRIVING AMOUNT, ONLY ENCODER 36b ON, AND LEADING END DETECTION SENSOR 12 OFF | SUPPLY MODE | DISPLAY ON OPERATION PANEL 20 AND WARN TO USER |
| II | SUPPLY | LEADING END DETECTION SENSOR 301b ON OR DETECT SPOOL DRIVING AMOUNT, ONLY ENCODER 36b ON, AND LEADING END DETECTION SENSOR 12 ON | WINDING MODE | DISPLAY ON OPERATION PANEL 20 AND WARN TO USER |

PRINTING APPARATUS

BACKGROUND OF THE INVENTION

Field of the Invention

The present invention relates to a printing apparatus having a supply function and a winding function.

Description of the Related Art

Japanese Patent Laid-Open No. 2013-116561 discloses an image forming apparatus having a configuration in which a roll sheet can be installed and having both a supply function of supplying a sheet and a winding function of winding up a sheet. In this image forming apparatus, it is determined whether a set spool is for supply or for winding to control driving of the spool according to the determination.

The apparatus disclosed in Japanese Patent Laid-Open No. 2013-116561 is configured to discharge a printed sheet to a basket or to wind a printed sheet around a paper tube. In a mode of discharging a printed sheet to a basket, if a sheet after printing has an inward curl, the sheet may come inside the apparatus, failing to be discharged to the basket.

SUMMARY OF THE INVENTION

The present invention has been made to solve the above problems. An object of the present invention is to provide a printing apparatus having a supply function and a winding function, in which a sheet is guided to a desirable position.

According to a first aspect of the present invention, there is provided a printing apparatus comprising: a supply unit configured to hold a plurality of rolls of a wound continuous sheet; a printing unit configured to print an image on a sheet drawn from one of the rolls held by the supply unit; a storage unit configured to store a sheet printed in the printing unit; and a guiding unit configured to guide a sheet discharged from the printing unit to the storage unit, wherein the guiding unit is capable of switching between guiding the sheet discharged from the printing unit to the storage unit and guiding the sheet discharged from the printing unit to the supply unit so that the sheet is wound.

According to a second aspect of the present invention, there is provided a printing apparatus comprising: a supply unit including a first holding unit and a second holding unit each configured to hold a roll of a wound continuous sheet; a printing unit configured to print an image on a sheet drawn from one of the rolls held by the supply unit; a storage unit configured to store a sheet printed in the printing unit; and a detection unit configured to detect a sheet supplied from the supply unit toward the printing unit, wherein it is possible to perform a first mode in which a sheet drawn from the first holding unit or the second holding unit and printed in the printing unit is discharged to the storage unit, and a second mode in which a sheet drawn from the roll held by the first holding unit and printed in the printing unit is wound in the second holding unit, and wherein in a case where in the first mode, the detection unit does not detect a sheet supplied from the first holding unit or the second holding unit, or in a case where in the second mode, the detection unit does not detect a sheet supplied from the first holding unit, a user is notified of confirmation of the mode.

Further features of the present invention will become apparent from the following description of exemplary embodiments (with reference to the attached drawings).

BRIEF DESCRIPTION OF THE DRAWINGS

FIGS. 8A and 8B are tables showing foolproofs;

DESCRIPTION OF THE EMBODIMENTS

First Embodiment

Figure 1:
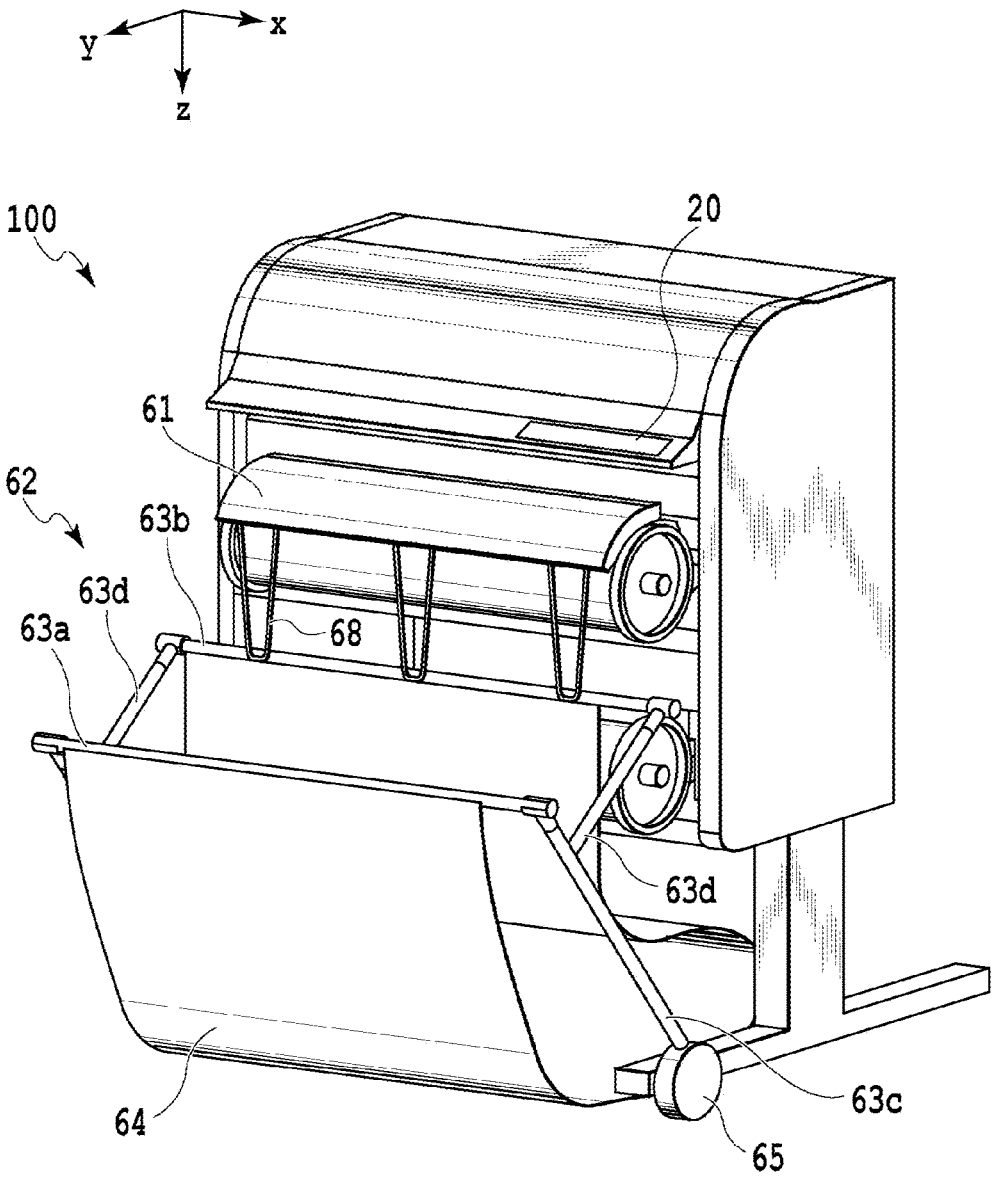
FIG. 1 is a perspective view showing an outer appearance of a printing apparatus.

FIG. 1 is a perspective view showing an outer appearance of a printing apparatus (hereinafter referred to as "a printer") 100 of the present embodiment. Although its details will be described later, the printer 100 has a plurality of (herein two) roll supply units (supply units). FIG. 1 shows an outer appearance of the printer 100 in which both roll supply units can supply a sheet and a sheet 1 is discharged to a basket (a storage unit) 62. It should be noted that the roll supply unit may be used as a supply unit capable of supplying a sheet or a winding unit for winding up a sheet, and is configured to switch between functioning as a supply unit and functioning as a winding unit as needed.

Figure 4A:
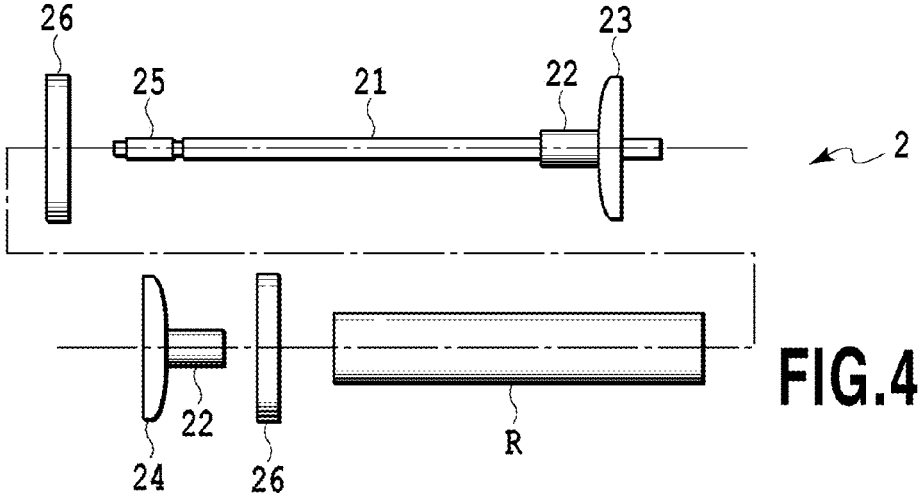
FIGS. 4A to 4C are views illustrating a method for setting a roll sheet.
Figure 4B:
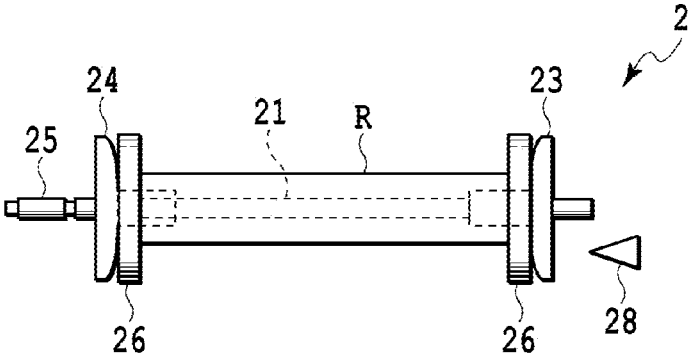
Figure 4C:
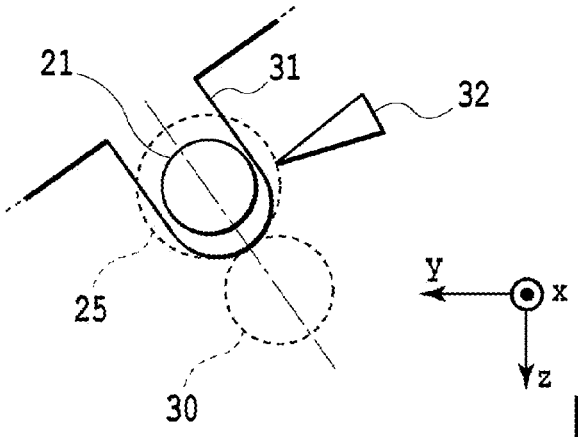
Figure 17A:
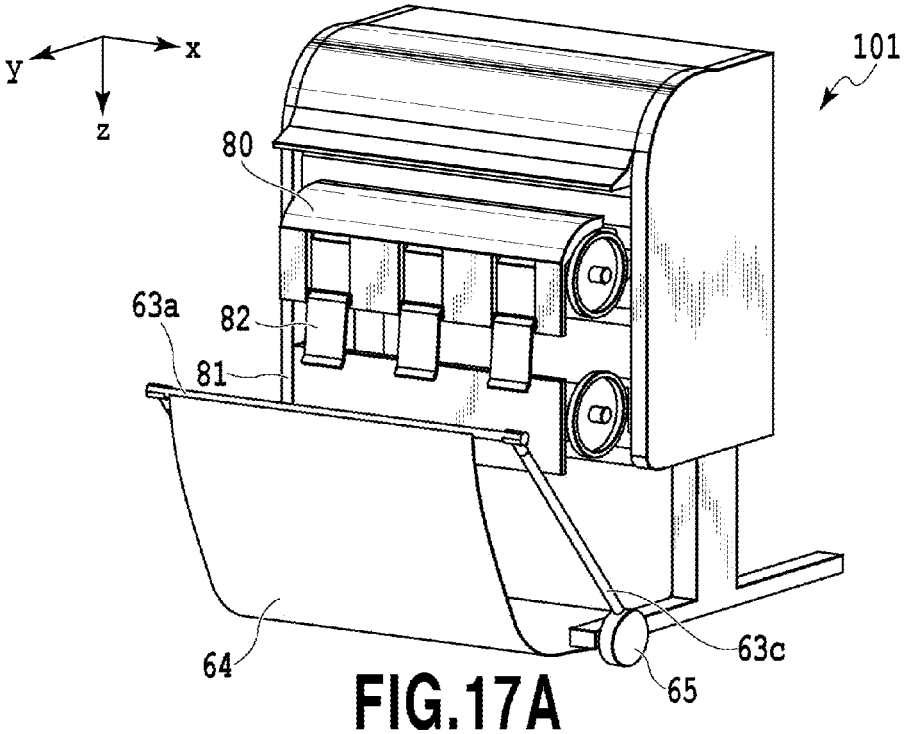
FIGS. 17A and 17D are perspective views showing a printing apparatus of a second embodiment.
Figure 17B:
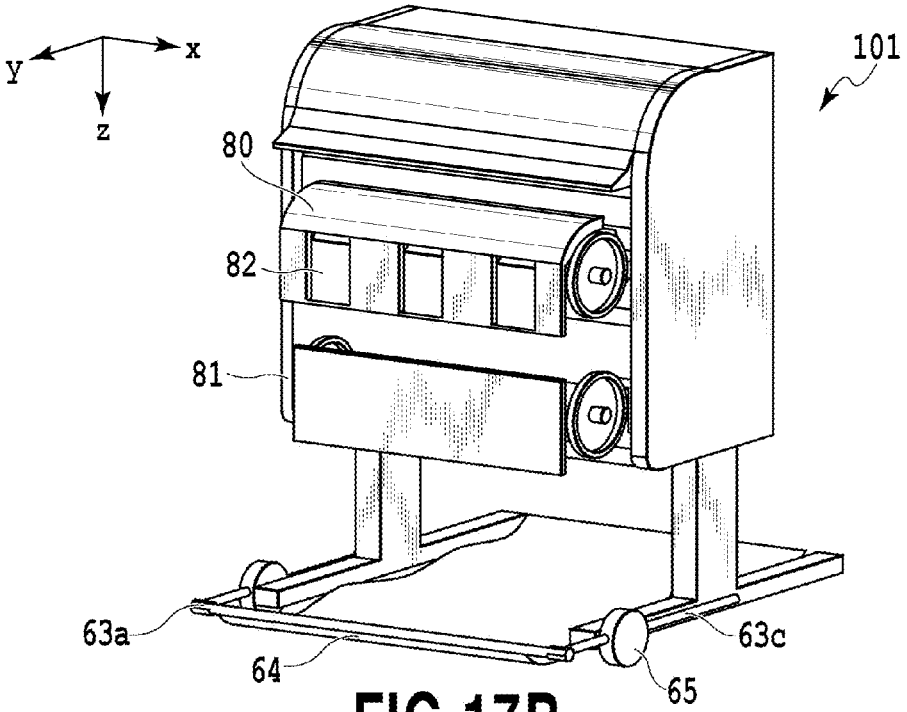

As shown in FIG. 1, the printer 100 is provided with an operation panel (a notification unit and an accepting unit) 20. A user uses various switches or the like provided on the operation panel 20 to input various commands for the printer 100, such as a command to set a size of a sheet and a command to switch online/offline. The basket 62 is provided on a downstream side in a direction in which a sheet is conveyed (a y direction shown in FIG. 1), and a sheet discharged from the printer 100 is stored in the basket 62. It should be noted that in FIGS. 1, 17A, and 17B, illustration of a spool holder 31 and the like which will be described later with reference to FIGS. 4A to 4C is omitted.

Figure 2:
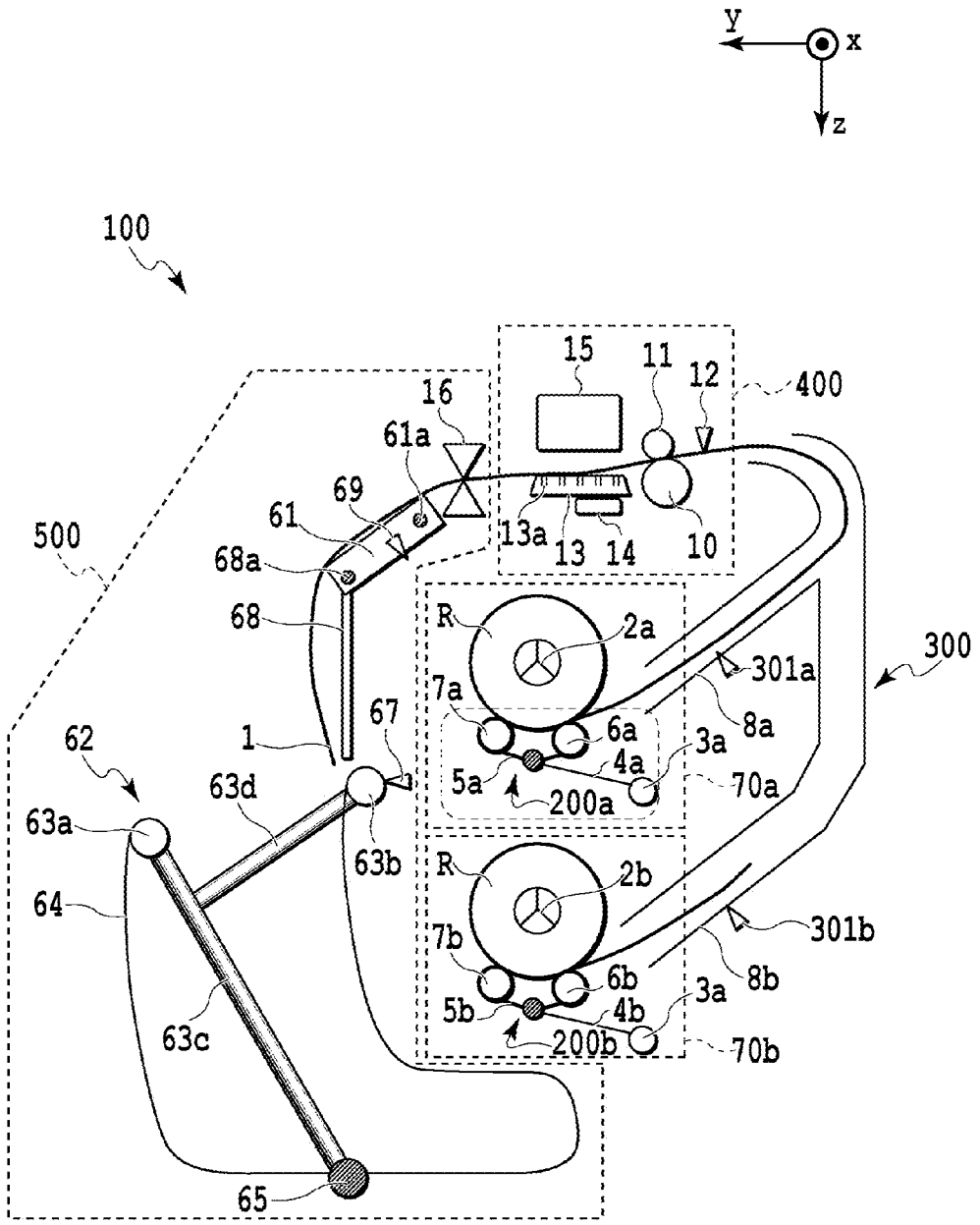
FIG. 2 is a schematic cross-sectional view showing a configuration of the printing apparatus.
Figure 11:
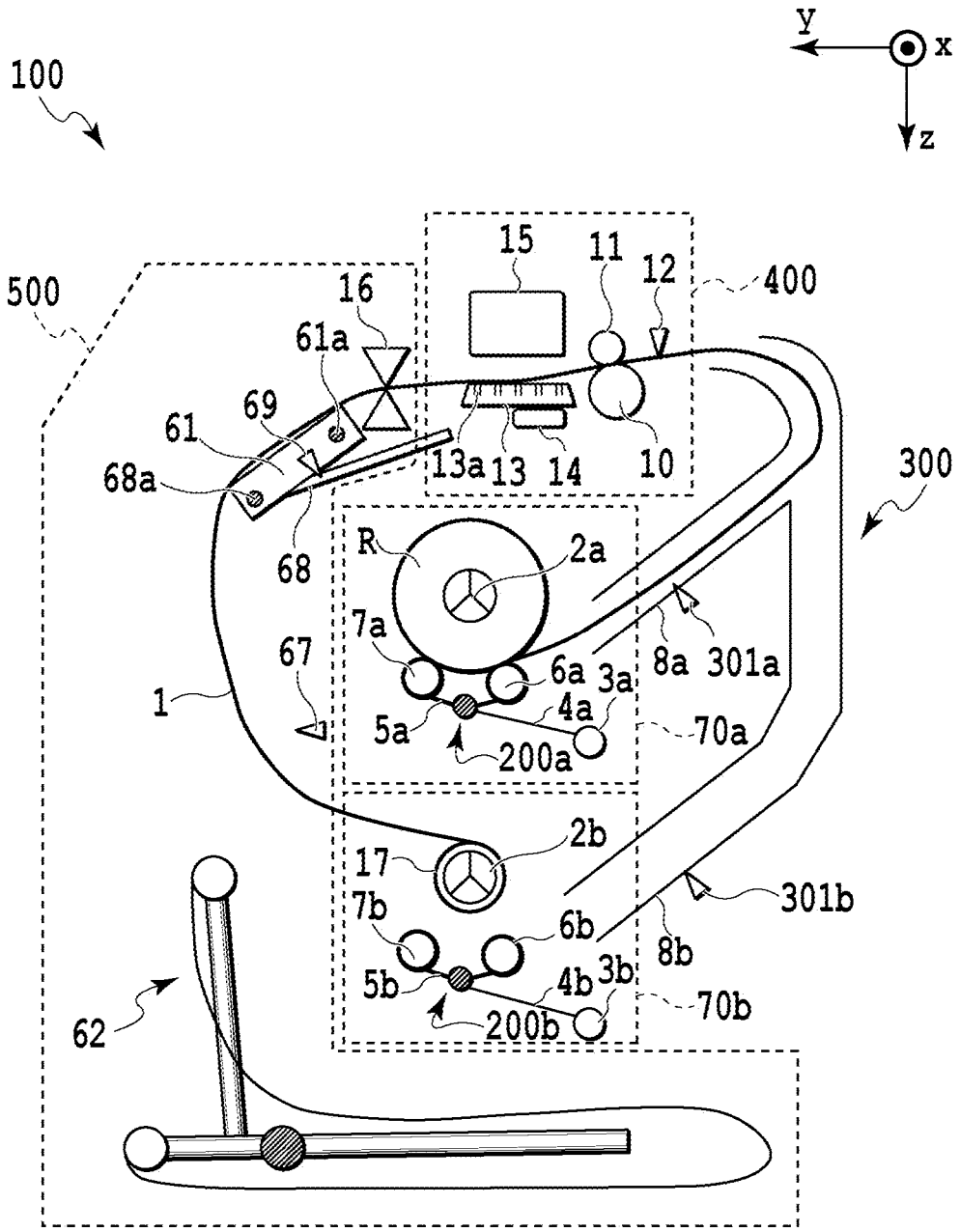
FIG. 11 is a schematic cross-sectional view showing a configuration of the printing apparatus when a sheet is wound.

With reference to FIG. 2 and the like, a description will be given of a configuration of the printer 100 in a case where all of the roll supply units are used as supply units. With reference to FIG. 11 and the like, a description will be given of a configuration of the printer 100 in a case where any roll supply unit is used as a winding unit.

FIG. 2 is a schematic cross-sectional view showing a configuration of the printer 100. As shown in FIG. 2, the printer 100 includes a roll supply unit 70*a*, a roll supply unit 70*b*, a conveying unit 300, a printing unit 400, and a discharge unit 500. To each of the roll supply units 70*a* and 70*b*, a roll sheet of a long continuous sheet wound in a roll is set. A continuous sheet 1 is drawn from a rolled portion (a roll unit) of a roll sheet R of the roll supply unit 70*a*, and the sheet 1 is conveyed by the conveying unit 300 toward the printing unit 400.

As shown in FIG. 2, the roll supply unit 70*a* and the roll supply unit 70*b* have an auxiliary mechanism 200*a* and an auxiliary mechanism 200*b*, respectively. As used herein, reference numerals with "a" particularly refer to members related to the roll supply unit 70*a* and reference numerals with "b" particularly refer to members related to the roll supply unit 70*b*. When descriptions are collectively given without making a distinction between the members related to the roll supply unit 70*a* and the members related to the roll supply unit 70*b*, the members are indicated by reference numerals without "a" or "b." The roll supply units 70*a* and 70*b* are collectively referred to as "a roll supply unit 70."

The auxiliary mechanism 200 has a spool member 2, a rotation shaft 3, an arm member 4, a swinging member 5, a driven rotor 6 (a rotor), and a driven rotor 7 (a rotor). To a hollow core of the roll sheet R, a spool shaft 21 (described later) of the spool member 2 is inserted, whereby the roll sheet R is rotatable forward and backward with the rotation of the spool shaft 21. The driven rotor 6 and the driven rotor 7 (hereinafter referred to also as "support rotors") are rollers and provided below the roll sheet R in a z direction. A plurality of the driven rotor 6 and the driven rotor 7 are provided in a width direction of the roll sheet R (an x direction in the figure (a sheet width direction)). In the printer 100, rotation of the roll sheet R and driven rotation of the support rotors in contact with the outer periphery of the roll unit of the roll sheet R allow the sheet 1 to be delivered from the roll unit.

The conveying unit 300 conveys the sheet 1 delivered from the roll supply unit 70 to the printing unit 400. The conveying unit 300 has a conveying guide 8. The conveying guide 8 guides both sides of the sheet 1 and leads the sheet 1 to the printing unit 400. It should be noted that an area of the conveying guide 8 in proximity to the printing unit 400 is shaped along a curling direction of the roll sheet R. Using the conveying guide 8 having such a shape allows the sheet 1 to be smoothly conveyed in a direction along curling of the sheet 1. In the conveying unit 300, near a portion serving as a path entry of the sheet supplied from the roll supply unit 70, a leading end detection sensor 301 (a second detection unit) is provided. The leading end detection sensor 301 and a leading end detection sensor 12 (a third detection unit) which will be described later detect a sheet and output a detection signal. The signal is used as a trigger or the like of rotation control of each motor. In a case where a sheet is not detected by the leading end detection sensor 301 or the leading end detection sensor 12 even if a predetermined time has elapsed since a supply operation of a sheet started, for example, a CPU (a control unit) 201 which will be described later with reference to FIG. 6 controls the units and performs various kinds of processing.

In an upstream side in the y direction of the printing unit 400, there are provided the leading end detection sensor 12 and a roller pair consisting of a conveying roller 10 and a pinch roller 11 in the order from the upstream side in the y direction. The conveying roller 10 rotates forward and backward according to a direction of the rotation of a conveying roller driving motor 35 which will be described later with reference to FIG. 6. The pinch roller 11 is located such that the sheet 1 is sandwiched between the pinch roller 11 and the conveying roller 10, and can be driven to rotate according to the rotation of the conveying roller 10. The pinch roller 11 can also adjust a distance from the conveying roller 10 by moving upward or downward in the z direction by a separation motor (not shown) so as to adjust a nip force.

If the leading end detection sensor 12 detects a leading end of the sheet 1, the CPU 201 which will be described later with reference to FIG. 6 controls the conveying roller driving motor 35 to rotate the conveying roller 10. The sheet 1 is sandwiched between the conveying roller 10 and the pinch roller 11 and the sheet 1 is conveyed by the rotation of the conveying roller 10 and the rotation of the pinch roller 11 driven by the rotation of the conveying roller 10.

The printing unit 400 has an ink jet type print head 15. An ejection port is provided on a surface (an ejection port surface) of the print head 15 which faces the sheet 1. Ink is ejected from the ejection port and applied to the conveyed sheet 1 so that an image or the like is printed on the sheet 1. A platen 13 is provided so as to locate the sheet 1 between the platen 13 and the ejection port surface and has a support surface for supporting the sheet 1. The support surface of the platen 13 is provided with a suction port 13*a*. A suction fan 14 for sucking air from the suction port 13*a* is provided below the platen 13 in the z direction. When the sheet 1 is located in a space between the print head 15 and the platen 13, the suction fan 14 is activated so that air is sucked from the suction port 13*a* to prevent the sheet 1 from coming into contact with the ejection port surface of the print head 15.

The sheet 1 having an image or the like printed in the printing unit 400 comes out from the printing unit 400 and is conveyed to the discharge unit 500. The discharge unit 500 has a cutter 16, a discharge guide 61, and a basket 62. The cutter 16 is provided downstream of the printing unit 400 in the y direction and cuts the sheet 1. The cut sheet 1 is guided by the discharge guide 61 toward the basket 62 and stored in the basket 62.

The discharge guide 61 can rotate around a shaft 61*a* in a clockwise direction and a counterclockwise direction as viewed from the front in the figure. This allows the discharge guide 61 to be located at a position at which the discharge guide 61 guides the sheet 1 when the printer 100 is working and to be retracted into a position at which the discharge guide 61 does not interfere with the operation of the user when the roll sheet is set on the roll supply unit 70*a* or the like. As shown in FIG. 1, the discharge guide 61 is a mold component formed across the entire area in the width direction (the x direction shown in the figure) of the sheet 1.

To an end of the discharge guide 61 in the downstream side in the y direction and in the lower side in the z direction, a guide member 68 is attached. The guide member 68 is a movable guide member rotatably attached to the discharge guide 61 around a shaft 68*a*. The guide member 68 may be located at a position shown in FIG. 3B or the like (described later) in which the guide member 68 is housed in the discharge guide 61, and a position shown in FIG. 1 or the like in which the guide member 68 hangs under its own weight in the gravity direction (the z direction) and extends downward from the end of the discharge guide 61. The guide member 68 can rotate between these positions. Here, the guide member 68 is formed by forming/processing wires. As shown in FIG. 1, three guide members 68 are attached to the discharge guide 61, and the guide members 68 are attached to both end portions and the center portion in the x direction of the discharge guide 61. The discharge guide 61 has a position detection sensor (a first detection unit) 69. The position detection sensor 69 outputs a detection signal when the guide members 68 are housed in the discharge guide 61. Here, the discharge guide 61 and the guide members 68 constitute a guide unit.

The basket 62 has rods 63*a* to 63*d* and a cloth member 64. As shown in FIG. 1 and FIG. 2, the rods 63*a* and 63*b* extend in the x direction. The rods 63*c* extend in a diagonal z direction, and are arranged on both right and left sides in the x direction shown in FIG. 1. One end portion of each rod 63*c* is connected to the rod 63*a* and the other end portion of the rod 63*c* is rotatably attached to a member 65 attached to a stand of the printer 100. To a portion of each rod 63*c* near the rod 63*a*, the rod 63*d* is attached. An end portion of each rod 63*d* opposite to the end near the rod 63*c* is attached to the rod 63*b*. That is, the rod 63*b* and the rod 63*c* are connected by the rod 63*d*. One end of the cloth member 64 in the y direction is attached to the rod 63*a* and the other end of the cloth member 64 in the y direction is attached to the rod 63*b*.

Further, the printer 100 is provided with a position detection sensor 67. If the basket 62 is open as shown in FIG. 2, the position detection sensor 67 detects the rod 63*b* and outputs a detection signal.

Figure 3C:
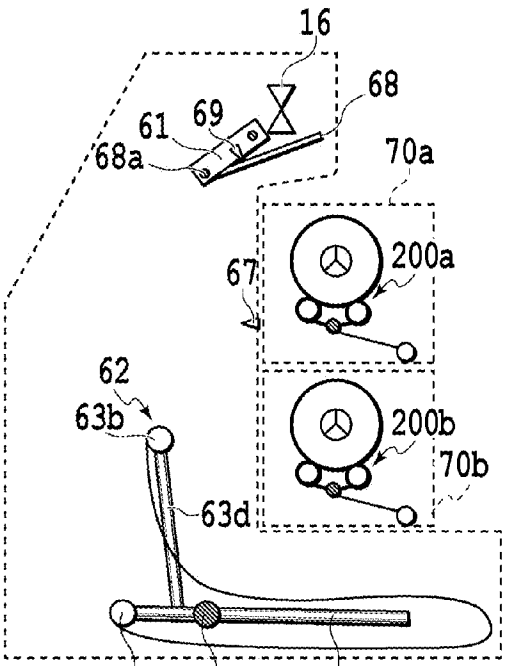
FIGS. 3A to 3C are schematic cross-sectional views showing a discharge unit.
Figure 3B:
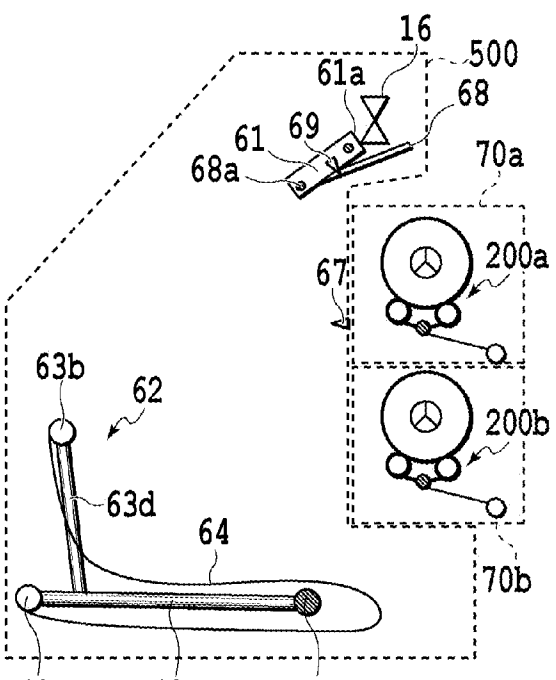
Figure 3A:
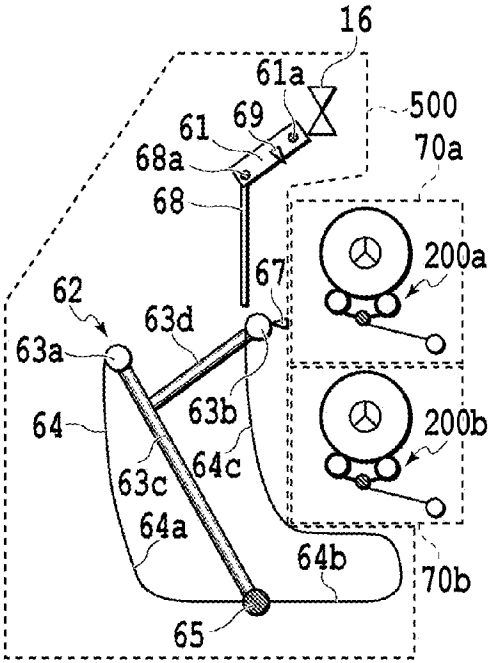

FIGS. 3A to 3C are schematic cross-sectional views showing the discharge unit 500. FIG. 3A shows the state in which the basket 62 is open. FIG. 3B shows the state in which the guide member 68 is housed in the discharge guide 61 and the basket 62 is closed. FIG. 3C shows the state in which the guide member 68 is housed in the discharge guide 61 and the basket 62 is housed below the roll supply unit 70*b* in the z direction.

In a case where both of the roll supply units 70*a* and 70*b* are used as supply units, the basket 62 is kept open and the sheet cut by the cutter 16 is guided by the guide member 68 and stored in the basket 62. As shown in FIG. 3A, in the state in which the basket 62 is open, the cloth member 64 has portions 64*a*, 64*b*, and 64*c* forming a bag portion. In the order from the upstream side in the y direction, the portions 64*c*, 64*b*, and 64*a* are provided. The guide member 68 is provided between the discharge guide 61 and the portion 64*c*, and the sheet cut by the cutter 16 is guided by the discharge guide 61, the guide member 68, and the portion 64*c* and stored in the bag portion formed by the portions 64*a*, 64*b*, and 64*c*. Between the guide member 68 and the rod 63*b* to which one end of the cloth member 64 is attached, there is no space so that a leading end of the sheet 1 does not enter. Accordingly, the sheet discharged from the printer 100 is prevented from entering the roll supply unit 70 again.

In a case where the basket 62 is not used, the rod 63*c* is rotated around the member 65 in the counterclockwise direction as viewed from the front in the figure, from the state shown in FIG. 3A to a position parallel to or substantially horizontal to the installation surface of the printer 100. Accordingly, the rod 63*c* comes to the state shown in FIG. 3B. If the rod 63*c* is moved from the state shown in FIG. 3B in a thrust direction to be housed in the position below the roll supply unit 70*b* in the z direction, the rod 63*c* comes to the state shown in FIG. 3C.

In a case where the guide member 68 is in the state shown in FIGS. 3B and 3C, discharging the sheet without winding may cause the discharged sheet to enter the roll supply unit due to an influence of the curling or the like of the sheet. This may cause the discharged sheet to be folded or tore or the like or cause the discharged sheet to come into contact with the roll sheet R, and ink on the discharged sheet may adhere to the roll sheet R. Further, the discharged sheet may stick to the roll sheet R by static electricity and this may cause the discharged sheet to be conveyed together when a sheet is supplied from the roll sheet R. Meanwhile, in a case where the guide member is in the state shown in FIG. 3A, a sheet may be prevented from traveling toward the roll supply unit used as a winding unit when a sheet is wound. Further, when the roll sheet R or a paper tube 17 which will be described later with reference to FIG. 11 is set on the roll supply unit, the guide member 68 and the discharge guide 61 may interfere with the setting operation.

To cope with the above problems, the movable guide member 68 is used in this example. When the discharged sheet is stored in the basket 62, the guide member 68 is arranged at a position extending below in the z direction to prevent the discharged sheet from entering the roll supply unit. Meanwhile, when the roll sheet R is replaced or the sheet is wound up, the guide member 68 is housed in the discharge guide 61 so that the guide member 68 may not interfere with the operation when the roll sheet R is set or the sheet is wound up or the like. Further, in this example, to determine whether user recognition corresponds with a control mode of the printer, the position detection sensors 67 and 69 are used.

In the state shown in FIG. 3A, since the guide member 68 is not housed in the discharge guide 61, the position detection sensor 69 does not output a detection signal, but the position detection sensor 67 detects the rod 63*b* and outputs a detection signal since the basket 62 is open. In the states shown in FIGS. 3B and 3C, the position detection sensor 69 outputs a detection signal since the guide member 68 is housed in the discharge guide 61, but the position detection sensor 67 does not detect the rod 63*b* and does not output a detection signal. The CPU 201 which will be described later with reference to FIG. 6 determines the states of the basket 62 and the guide member 68 from the detection results from the position detection sensors 67 and 69, that is, the current state of the printer 100. In a case where the basket 62 is housed or the guide member 68 is housed, using both units of the roll supply unit 70 as supply units results in a warning given to a user by displaying the message on the operation panel or the like. Details will be described later with reference to FIG. 7.

FIGS. 4A to 4C are views illustrating a method for setting the roll sheet R on the spool member 2 which is a support unit. The spool member 2 includes the spool shaft 21, a friction member 22, a reference spool flange 23, a non-reference spool flange 24, a spool rotary gear 25, and two flange attachments 26. As shown in FIG. 4A, one end of the spool shaft 21 is provided with the reference spool flange 23. The other end of the spool shaft 21 is provided with the spool rotary gear 25 for rotating the spool shaft 21. Further, the friction member 22 is provided inside of each of the reference spool flange 23 and the non-reference spool flange 24 (the sides in which the reference spool flange 23 and the non-reference spool flange 24 face each other). One flange attachment 26 is removably attached to the reference spool flange 23 and the other flange attachment 26 is removably attached to the non-reference spool flange 24 by using a member having a spring property such as a hook. The flange attachment 26 is removed from the flange when the roll supply unit is used as a winding unit or the like, but may be integrally handled with the flange in other cases.

To set the roll sheet R on the spool member 2, first, the non-reference spool flange 24 which engages with the spool shaft 21 and the flange attachment 26 attached to the non-reference spool flange 24 are integrally detached. The spool shaft 21 is passed through the hollow core of the roll sheet R, and the roll sheet R is fitted to the flange attachment 26 attached to the reference spool flange 23 until the side portion of the roll sheet R comes into contact with the flange attachment 26, so that the friction member 22 comes into contact with the inner surface of the roll sheet R. Then, the non-reference spool flange 24 and the flange attachment 26 integrated with the non-reference spool flange 24 are passed through the spool shaft 21 so that the friction member 22 provided inside the non-reference spool flange 24 is fitted to the hollow core of the roll sheet R. Accordingly, the position of the non-reference spool flange 24 is fixed. The roll sheet R is fixed to and held by the spool member 2 by the friction member 22 being wedged into the inner surface of the hollow core of the roll sheet R with the elastic force in a radial direction, and is rotated with the rotation of the spool shaft 21. If the roll sheet R is set on the spool member 2, as shown in FIG. 4B, the spool member 2 and the roll sheet R are integrated.

The printer 100 is provided with a flange attachment detection sensor 28. The flange attachment detection sensor 28 is a reflection type sensor. In this example, a description will be given of the case where a user selects from using the roll supply unit as a supply unit and using the roll supply unit as a winding unit by using a switch provided on the operation panel 20. However, it is also possible to determine, by using a detection result from the flange attachment detection sensor 28, as which unit the roll supply unit should be used. In this case, the CPU 201 which will be described later with reference to FIG. 6 determines to use the roll supply unit as a supply unit if the flange attachment 26 is attached to the reference spool flange 23. If the flange attachment 26 is not attached to the reference spool flange 23, the CPU 201 determines to use the roll supply unit as a winding unit. Further, if the printer 100 is provided with a selector switch, the user may determine, by the operation of the selector switch, as which unit the roll supply unit should be used. In this manner, a selection method for determining whether to use the roll supply unit as a supply unit or to use the roll supply unit as a winding unit is not particularly limited.

FIG. 4C is a side view showing a state in which the spool member 2 is held in the spool holder 31 provided on the printer 100 body. The printer 100 is provided with the spool holder 31 which is a holding unit for holding the spool member 2. The spool holder 31 is provided on each of a position corresponding to the reference spool flange 23 and a position corresponding to the non-reference spool flange 24 so that the spool member 2 may be arranged on a desirable position of the printer 100. The spool holder 31 has a substantially U-shaped cross-section as viewed from the front in the figure and has an opening that is open upward in the z direction. The spool shaft 21 is configured to be fitted into this opening. The user puts down the spool member 2 diagonally downward from the upper side toward the lower side in the z direction so as to set the spool member 2 on the spool holder 31.

A spool driving gear 30 is provided at a position in which the spool driving gear 30 engages with the spool rotary gear 25 in a state in which the spool shaft 21 is fitted into the spool holder 31. The spool driving gear 30 is driven to rotate by a spool driving motor 34 which will be described later with reference to FIG. 6, and this rotation is transmitted from the spool driving gear 30 to the spool rotary gear 25. The rotation of the spool rotary gear 25 causes the spool shaft 21 to rotate. With the rotation of the spool shaft 21, the roll sheet R supported by the spool member 2 also rotates, and the sheet 1 is fed from the roll supply unit 70. Furthermore, by rotating the roll sheet R in a direction opposite to the feeding direction, the sheet 1 is wound back.

A spool detection sensor 32 detects whether the spool member 2 is set on the spool holder 31. Therefore, as shown in FIG. 4C, the spool detection sensor 32 is provided at a position in which it can detect the spool member 2 in a state in which the spool member 2 is placed in the spool holder 31.

In the above manner, the roll sheet R integrated with the spool member 2 is placed in the spool holder 31 provided in the printer 100, whereby the roll sheet R is set on the printer 100.

Figure 5A:
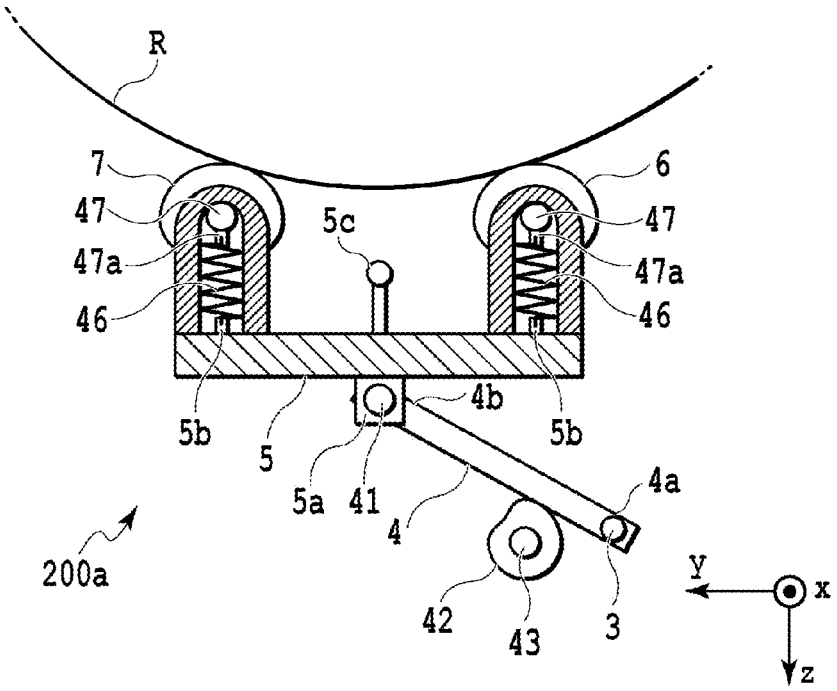
FIGS. 5A and 5B are views illustrating a configuration of support rotors.
Figure 5B:
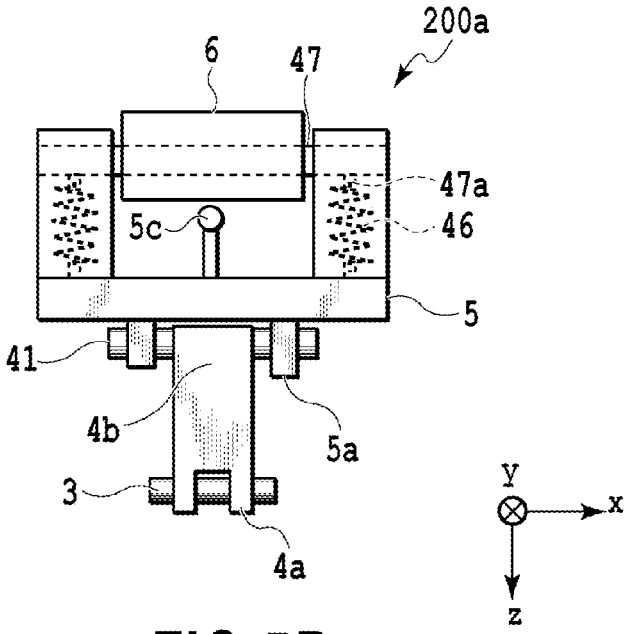

FIGS. 5A and 5B are views illustrating a configuration of the auxiliary mechanism 200*a*. FIG. 5A is an enlarged cross-sectional view of an area indicated by broken lines shown in FIG. 2. FIG. 5B shows a state of the auxiliary mechanism 200*a* shown in FIG. 5A as viewed from the downstream side in the feeding direction. In this example, a description of the configuration of the auxiliary mechanism 200*a* will be given. The auxiliary mechanism 200*b* has the same configuration. As shown in FIGS. 5A and 5B, the auxiliary mechanism 200*a* includes the arm member 4, the swinging member 5, the driven rotors 6 and 7, and the like.

The rotation shaft 3 shown in FIGS. 5A and 5B is rotatably attached to the printer 100 body, and both ends of the rotation shaft 3 are restricted in the thrust direction by ring members (not shown). The rotation shaft 3 engages with an engaging unit 4*a* provided on one end of the arm member 4. An engaging unit 4*b* provided on the other end of the arm member 4 slidably engages with a shaft member 41. Both ends of the shaft member 41 are restricted in the thrust direction by the ring members (not shown). The shaft member 41 slidably engages with an engaging unit 5*a* provided on a center position of the swinging member (a rotor holding unit) 5 in the y direction.

As shown in FIG. 5A, a surface of the swinging member 5 facing upward in the z direction is provided with a distance sensor 5*c*. In this example, a non-contact reflection type sensor is used as the distance sensor 5*c*, but a contact sensor may also be used. In this example, the distance sensor 5*c* is used, and an outer diameter of the roll sheet R is obtained from a distance between the outer surface of the roll sheet R and the driven rotors 6 and 7. It should be noted that the distance sensor 5*c* is located in a substantially center portion in the y direction on the surface of the swinging member 5 facing upward in the z direction, and a fixing unit 5*b* is provided on each of both ends of the swinging member 5 in the y direction, which are equally separated from the distance sensor 5*c*.

To the fixing unit 5*b*, one end of a compression spring (an elastic body) 46 is fixed. The other end of the compression spring 46 is fixed to a projection portion 47*a* of a shaft member 47. The compression spring 46 urges the shaft member 47 from the lower side toward the upper side in the z direction. The shaft member 47 in the downstream side in the feeding direction rotatably engages with the driven rotor 6, and the shaft member 47 in the upstream side in the feeding direction rotatably engages with the driven rotor 7. Since the compression spring 46 urges the shaft member 47 from the lower side toward the upper side in the z direction, the driven rotors 6 and 7 which engage with the shaft member 47 are configured to abut on the outer periphery of the roll sheet R from the lower side toward the upper side in the z direction.

In a state in which the driven rotors 6 and 7 abut on the roll sheet R, the driven rotors 6 and 7 rotate with the rotation of the roll sheet R. The driven rotors 6 and 7 are spaced apart from each other in the feeding direction in which the sheet 1 is drawn from the roll unit of the roll sheet R. The driven rotor 7 is located far from the conveying guide 8 shown in FIG. 2 as compared to the position of the driven rotor 6, and in a state in which the driven rotor 7 abuts on the roll sheet R, the driven rotor abuts on and supports the roll sheet R from the lower side in the gravity direction (the z direction) so that the roll sheet R is not swaged.

As shown in FIG. 5A, the driven rotors 6 and 7 are located in positions substantially equally separated from the center position of the swinging member 5 in the y direction. This configuration equalizes forces of the driven rotors 6 and 7 abutting on the roll sheet R (abutting forces) by the swinging of the swinging member 5 around the shaft member 41.

A rotary cam 42 is provided in the lower side in the z direction, below the arm member 4. The arm member 4 urges the rotary cam 42 and is positioned according to the weights of the swinging member 5, the driven rotors 6 and 7, and the like. The rotary cam 42 engages with a shaft member 43.

A driving motor 33 which will be described later with reference to FIG. 6 causes the shaft member 43 to rotate, and accordingly, the rotary cam 42 rotates, whereby the arm member 4 rotates, the swinging member 5 swings, and the driven rotors 6 and 7 (support rotors) are displaced. In this example, the support rotors are positioned in an abutting position in which the support rotors abut on the outer periphery of the roll sheet R or a separation position in which the support rotors are separated from the outer periphery of the roll sheet R. Although details will be described later with reference to FIG. 7, in the feeding operation (the supply operation), the support rotors are arranged in the abutting position, whereas in skewing correction, the support rotors are arranged in the separation position.

Figure 6:
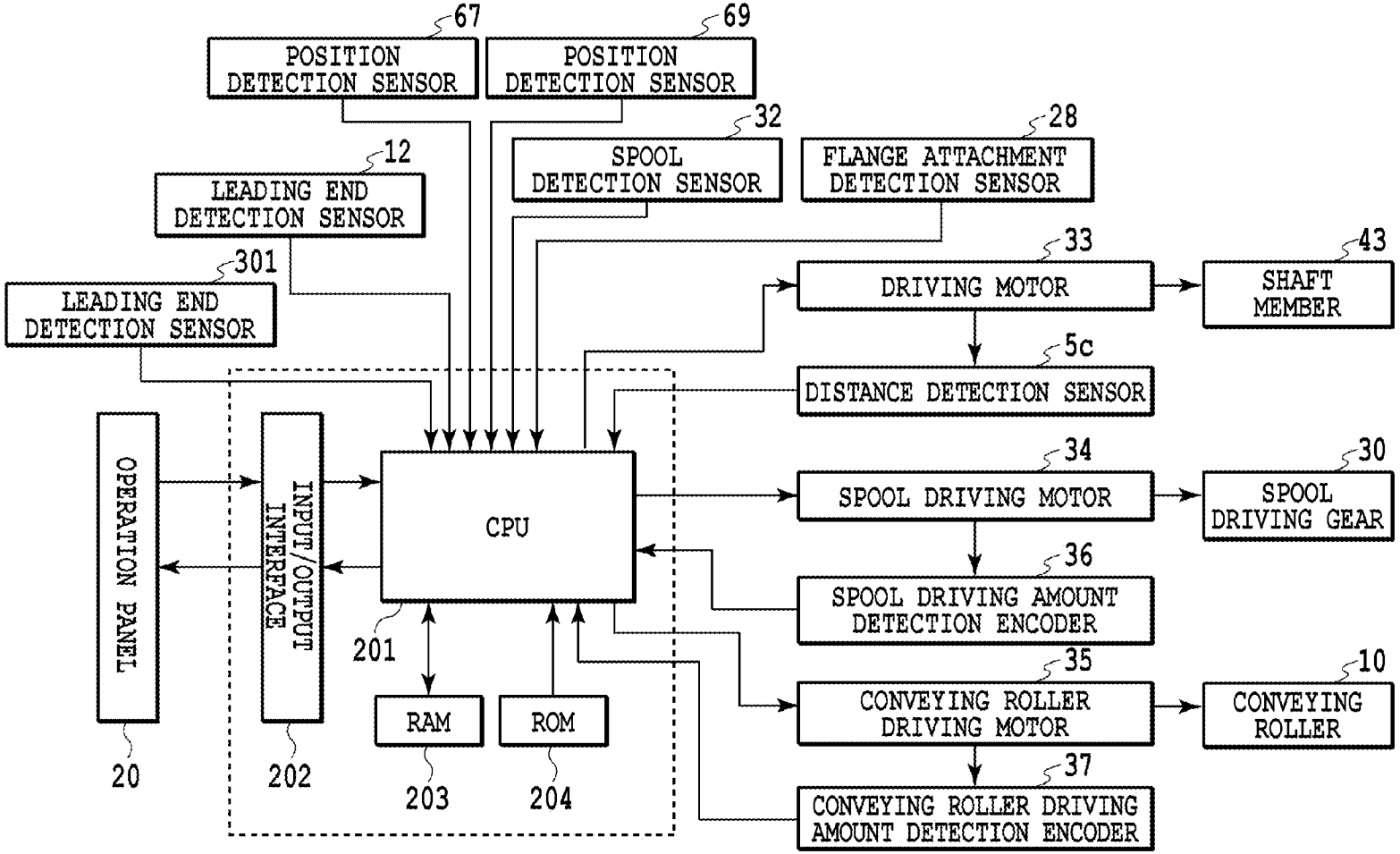
FIG. 6 is a block diagram showing a control configuration of the printing apparatus.

FIG. 6 is a block diagram showing a control configuration of the printer 100. As shown in FIG. 6, the printer 100 includes the CPU 201, an input/output interface 202, a RAM 203, and a ROM 204. The CPU 201 generally controls the printer 100. The ROM 204 stores various programs executed by the CPU 201 and unique data needed for various operations of the printer 100. The RAM 203 is used as a work area of the CPU 201 and a temporary storage area for various kinds of received data. Further, the RAM 203 stores various kinds of setting data.

The user operates the operation panel 20 to select a sheet type, a sheet size, and whether to use a roll supply unit as a supply unit or a winding unit, and input various kinds of setting information or the like. This information is inputted to the CPU 201 via the input/output interface 202. Further, the CPU 201 displays various kinds of information on the operation panel 20 via the input/output interface 202.

The printer 100 is connected to an external device, an external storage media, and the like (not shown). In this example, various kinds of processing are performed on image data in the external device, the external storage media, and the like to generate print data, and the print data is inputted to the CPU 201 via the input/output interface 202. The CPU 201 generally controls the printer 100 so as to print an image based on the print data. It should be noted that image data may be inputted from the external device, the external storage media, and the like (not shown) to the printer 100, and various kinds of processing may be performed on the image data in the CPU 201 of the printer 100 to generate print data.

The CPU 201 is connected to the distance sensor 5*c*, the flange attachment detection sensor 28, the spool detection sensor 32, the leading end detection sensors 12 and 301, and the position detection sensors 67 and 69. The CPU 201 writes information from these sensors to the RAM 203 and reads the written information. The CPU 201 is also connected to a spool driving amount detection encoder (a fourth detection unit) 36 and a conveying roller driving amount detection encoder 37. The spool driving amount detection encoder 36 detects a rotation amount (a rotation angle or the number of rotations) of the spool driving motor 34. The conveying roller driving amount detection encoder 37 detects a rotation amount of the conveying roller driving motor 35. The distance sensor 5*c*, the flange attachment detection sensor 28, the spool detection sensor 32, the driving motor 33, the spool driving motor 34, the spool driving amount detection encoder 36, and the like are provided on each of the roll supply units.

Although details will be described later, here, the positions of the support rotors are determined by using the distance sensor 5*c*. However, the positions of the support rotors may be determined by using encoders. In this case, the sheet 1 is sandwiched between the conveying roller 10 and the pinch roller 11, and detection values of the encoders when the sheet 1 is stretched and conveyed by a predetermined amount are compared, whereby a change in the outer diameter of the roll sheet R is obtained and the support rotors are arranged in desirable positions.

Figure 7:
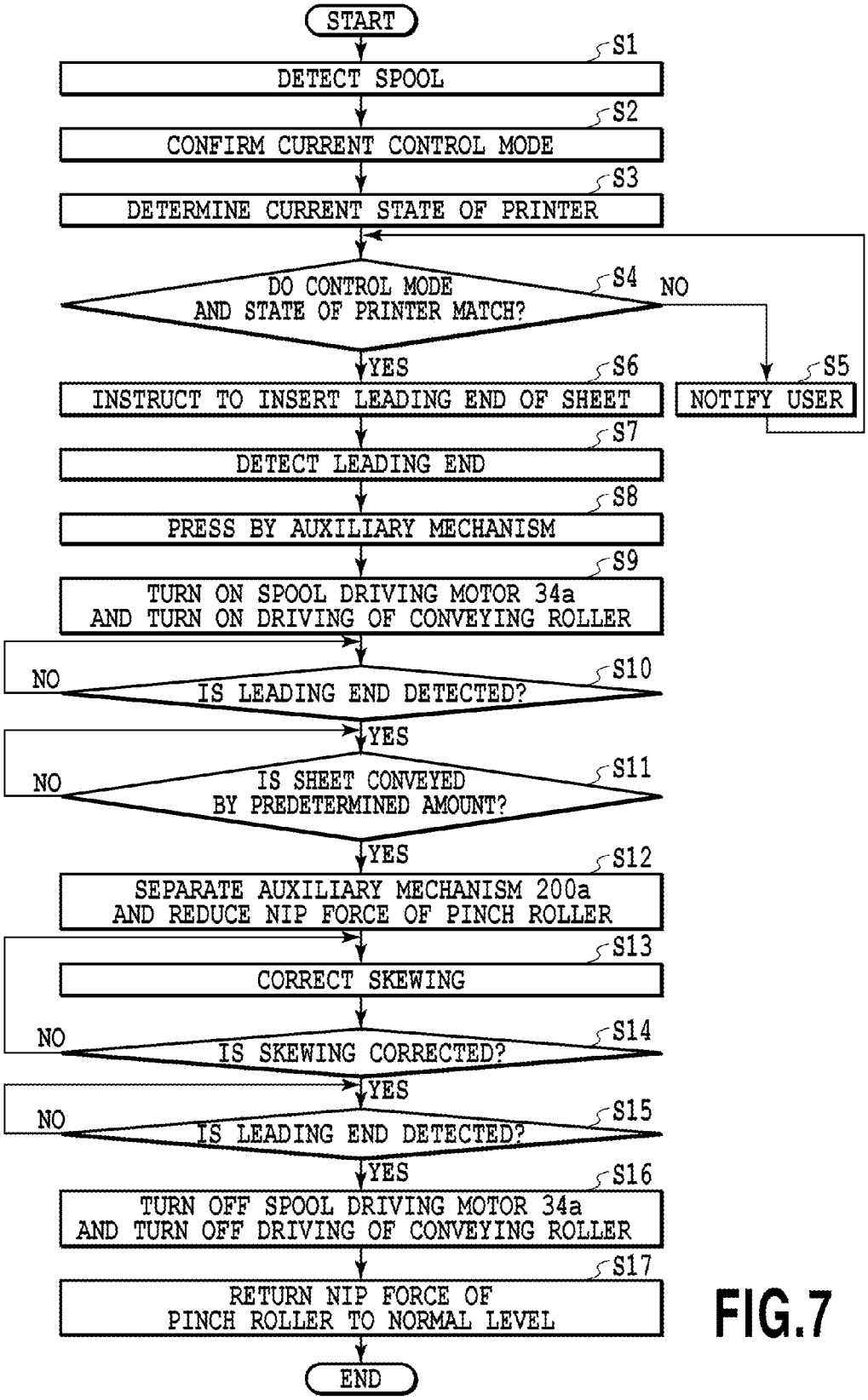
FIG. 7 is a flow chart showing a flow of a setting operation of a roll sheet.

FIG. 7 is a flow chart showing a flow of a setting operation of the roll sheet R and illustrating an operation of setting a leading end of the sheet to the position before starting a printing operation. As described above, the user operates the operation panel 20 to select from using the roll supply unit as a supply unit (supply mode) and using the roll supply unit as a winding unit (winding mode). In the supply mode, a printed sheet is discharged to the basket. Thus, the supply mode is also referred to as a discharge mode.

In this example, a description will be given of the case where the user operates the operation panel 20 to select a discharge mode in which the roll supply units 70*a* and 70*b* are used as supply units, and the printed sheet is discharged to the basket.

If the user turns on the printer 100, the processing shown in FIG. 7 is started. If the spool detection sensor 32 detects that the spool member 2 is set on the printer 100 (S1), the CPU 201 confirms a current control mode (S2). More specifically, the CPU 201 confirms whether the user has selected a discharge mode (supply mode) in which both of the roll supply units are used as supply units or a winding mode in which any roll supply unit is used as a winding unit (S2). Further, the CPU 201 determines, based on detection signals from the position detection sensors 67 and 69, a current state of the printer 100 (states of the guide member 68 and the basket 62) (S3). The CPU 201 compares the current control mode with the current state of the printer 100, and determines whether they correspond to each other (S4).

In this example, if the control mode and the state of the printer 100 correspond to each other, this means that in the printer 100, a sheet is guided to a desirable position when the control according to the control mode is performed. In this example, in the discharge mode (supply mode), in a case where the guide member 68 is not housed in the discharge guide 61 and the basket 62 is open so that it can store a sheet therein, the control mode and the state of the printer 100 match. In the winding mode, in a case where the guide member 68 is housed in the discharge guide 61 and the basket is closed, the control mode and the state of the printer 100 match. If they do not match, desirable processing such as printing or winding is not performed, or the user does not recognize that they do not match. To avoid such situations, in this example, it is determined whether the control mode and the state of the printer 100 match. If they do not match, the user is notified of the message to confirm the function to be used. In this example, a description will be given of the case where the user is notified by displaying, on the operation panel 20, the message that the control mode and the state of the printer 100 do not match. However, the user may also be notified by voice, for example.

FIGS. 8A and 8B are tables showing specific examples in which the control mode and the state of the printer 100 do not match, and foolproofs in the specific examples. FIG. 8A shows the case of determining the state of the printer 100 by using detection results from the position detection sensors 67 and 69. FIG. 8B shows the case of determining the state of the printer 100 by using detection results from the leading end detection sensors 12 and 301 and the spool driving amount detection encoder 36. The reason why the control mode and the state of the printer 100 do not match may be, for example, that the user forgets to perform a switching operation of the control mode on the operation panel 20 or that the user forgets to perform the setting operations after completing the switching operation on the operation panel 20. FIGS. 8A and 8B show the case where the user forgets to perform the switching operation of the control mode.

In FIG. 8A, I shows the case where the user tries to use the roll supply unit 70*b*, which has been used as a supply unit, as a winding unit, and houses the guide member 68 in the discharge guide 61 and houses the basket 62, but the user forgets to perform the switching operation of the control mode. In this case, when the position detection sensor 69 detects the guide member 68, or when the position detection sensor 67 does not detect the rod 63*b*, a warning is given to the user. In FIG. 8A, II shows the case where the user tries to use the roll supply unit 70*b*, which has been used as a winding unit, as a supply unit, and extends the guide member 68 in the z direction and opens the basket 62, but the user forgets to perform the switching operation of the control mode. In this case, when the position detection sensor 67 does not detect the guide member 68, or when the position detection sensor 67 detects the rod 63*b*, a warning is given to the user.

In FIG. 8B, I shows the case where the user tries to use the roll supply unit 70*b*, which has been used as a supply unit, as a winding unit, and sets the paper tube 17 on the roll supply unit 70*b*, but the user forgets to perform the switching operation of the control mode. In this case, when a leading end detection sensor 301*b* does not detect the leading end of the sheet or when only a spool driving amount detection encoder 36*b* detects a rotation amount and the leading end detection sensor 12 does not detect the leading end of the sheet, a warning is given to the user. As to the latter case, more specifically, the leading end detection sensor 12 does not detect the sheet since even if a spool member 2*b* is rotated by the number of rotations and the rotation angle required for the sheet to reach the detection area of the leading end detection sensor 12, the roll sheet R is not set on the roll supply unit 70*b*. Accordingly, when the leading end detection sensor 12 does not detect the leading end of the sheet even if the spool driving amount detection encoder 36*b* detects the predetermined number of rotations required for the sheet to reach the detection area of the leading end detection sensors 12, a warning is given to the user. In FIG. 8B, II shows the case where the user tries to use the roll supply unit 70*b*, which has been used as a winding unit, as a supply unit, and sets the roll sheet R on the roll supply unit 70*b*, but the user forgets to perform the switching operation of the control mode. In this case, when the leading end detection sensor 301*b* detects the leading end of the sheet or when only the spool driving amount detection encoder 36*b* detects a rotation amount and the leading end detection sensor 12 detects the leading end of the sheet, a warning is given to the user.

A description will be given of the case (FIG. 8A) of determining the state of the printer 100 by using detection results from the position detection sensors 67 and 69 in the flow shown in FIG. 7. However, a method for determining the state of the printer 100 is not limited to this. For example, the state of the printer 100 may be determined by using only the position detection sensor 67. That is, the state of the printer 100 may be determined depending on whether the guide member 68 is detected. Alternatively, the state of the printer 100 may be determined depending on whether the sheet is detected (FIG. 88). Further, the state of the printer 100 may be detected by using detection results from the flange attachment detection sensor 28 or the like. It should be noted that the number of sensors, the positions of the sensors, and the like used to determine the state of the printer 100 are not particularly limited to the above-described examples.

In a case where the current control mode and the current state of the printer 100 do not match (NO in S4), that is, in the case shown in FIGS. 8A and 8B, the CPU 201 gives a warning to the user by displaying the message on the operation panel 20 or the like (S5). Then, it is determined again whether the control mode and the state of the printer 100 match (S4).

Meanwhile, in a case where the control mode and the state of the printer 100 match (YES in S4), the CPU 201 displays an instruction to insert the leading end of the sheet to the conveying guide 8 on the operation panel 20 (S6). If the user rotates the roll sheet R and inserts the leading end of the sheet 1 to the conveying guide 8 according to the instruction, the leading end of the sheet 1 is detected by leading end detection sensors 301*a* or 301*b* (S7).

If detection signals are transmitted from the leading end detection sensors 301*a* or 301*b* to the CPU 201, the CPU 201 rotates the driving motor 33 so that the shaft member 43 rotates, and the rotation of the rotary cam 42 causes the arm member 4 to rotate. In this example, rotating forward the driving motor 33 causes the support rotors to move closer to the outer periphery of the roll sheet R, whereas rotating backward the driving motor 33 causes the support rotors to move away from the outer periphery of the roll sheet R. The distance sensor 5*c* measures a distance to the outer periphery of the roll sheet R, and the result is transmitted to the CPU 201.

The CPU 201 obtains the current positions of the support rotors based on the measurement result, controls the driving motor 33 accordingly, and arranges the support rotors to desirable positions. While obtaining the measurement result of the distance sensor 5*c*, the CPU 201 operates the driving motor 33 so that the support rotors are arranged in positions in which the force applied to the roll sheet R from the supply rotors (force abutting the support rotors on the roll sheet R) becomes a desirable force. More specifically, if the abutting force falls below a desirable abutting force, the CPU 201 further rotates forward the driving motor 33 to obtain a desirable abutting force. Meanwhile, if the abutting force exceeds a desirable abutting force, the CPU 201 rotates backward the driving motor 33. In this manner, the support rotors are arranged in positions in which the abutting force on the roll sheet R becomes a desirable abutting force, and the roll sheet R is pressed by the auxiliary mechanism 200 (S8).

In this example, a sheet is supplied from the roll supply unit 70*a*. At this time, the CPU 201 rotates forward a spool driving motor 34*a* and rotates the spool shaft 21*a* via a spool driving gear 30*a* and a spool rotary gear 25*a* to start the feeding operation of the sheet 1 (S9). Further, the CPU 201 rotates forward the conveying roller driving motor 35 as well to rotate the conveying roller 10 (S9). The forward rotation of the spool driving motor 34 and the conveying roller driving motor 35 means rotation in a direction in which the spool member 2 and the conveying roller 10 rotate in the counterclockwise direction as viewed from the front in FIG. 2.

When the sheet 1 is fed, the CPU 201 determines whether the leading end of the sheet 1 is detected by the leading end detection sensor 12 (S10). If the leading end of the sheet 1 is not detected by the leading end detection sensor 12 (NO in S10), the CPU 201 repeats the determination in S10 until the leading end of the sheet 1 is detected. If the leading end of the sheet 1 is detected by the leading end detection sensor 12 (YES in S10), the CPU 201 determines whether the sheet 1 is conveyed by a predetermined amount (S11). The predetermined amount means an amount, in a skewing correction operation, by which the leading end of the sheet 1 is not located in the upstream side in the feeding direction with respect to the positions of the conveying roller 10 and the pinch roller 11 even if the conveyance and the winding of the sheet 1 are repeated.

If the sheet 1 is not conveyed by the predetermined amount (NO in S11), the CPU 201 repeats the determination in S11 until the sheet 1 is conveyed by the predetermined amount. If the sheet 1 is conveyed by the predetermined amount (YES in S11), the CPU 201 rotates backward a driving motor 33*a* and causes an arm member 4*a* to rotate in a direction in which it moves away from the outer periphery of the roll sheet R by rotation of a rotary cam 42*a* along with rotation of a shaft member 43*a*. As a result, the auxiliary mechanism 200*a* is separated from the roll sheet R (S12). Further, the CPU 201 controls the separation motor (not shown) so as to separate the pinch roller 11 from the conveying roller 10 and reduce a nip force of the pinch roller 11 (S12).

Then, the CPU 201 controls the spool driving motor 34*a* and the conveying roller driving motor 35 and repeats the conveyance and the winding of the sheet 1 to correct skewing of the sheet 1 (S13). A sensor (not show) reads a position of the end of the sheet 1 to detect a skewing amount. Based on the information from the sensor (not shown), the CPU 201 determines whether the skewing of the sheet 1 is corrected (S14). If the skewing of the sheet is corrected (YES in S14), the CPU 201 finishes the skewing correction operation. If the skewing of the sheet 1 is not corrected (NO in S14), the skewing correction operation is continued until the skewing is corrected.

If it is determined that the skewing of the sheet 1 is corrected (YES in S14), the CPU 201 determines whether the leading end of the sheet 1 is detected by the leading end detection sensor 12 (S15). If the leading end of the sheet 1 is not detected (NO in S15), the CPU 201 winds back the sheet 1 until the leading end of the sheet 1 is detected by the leading end detection sensor 12. If the leading end of the sheet 1 is detected by the leading end detection sensor 12 (YES in S15), the CPU 201 controls the spool driving motor 34*a* and the conveying roller driving motor 35. More specifically, the CPU 201 controls the spool driving motor 34*a* and the conveying roller driving motor 35 to stop the rotation of the spool driving gear 30*a* and the conveying roller 10 (S16), and the winding-back operation of the sheet 1 is stopped.

The CPU 201 controls the separation motor (not shown) to move the pinch roller 11 closer to the conveying roller 10, and the nip force of the pinch roller 11 is returned to the nip force before the skewing correction operation (S17), and then the present processing is finished. In this manner, after the leading end of the sheet 1 from the roll unit of the roll sheet R is fed and the skewing of the sheet 1 is corrected, the leading end of the sheet 1 is set to the position before starting the printing operation. Then, the printer 100 enters a standby state in which the starting of the printing operation is awaited.

In the above, a description has been given of the case where, in the skewing correction operation, the sheet 1 is conveyed by the predetermined amount such that the leading end of the sheet 1 is not located in the upstream side in the feeding direction with respect to the positions of the conveying roller 10 and the pinch roller 11. Depending on a skewing amount of the sheet 1, however, in the skewing correction operation, the leading end of the sheet 1 may be wound back to the upstream side in the feeding direction with respect to the positions of the conveying roller 10 and the pinch roller 11. In this case, the support rotors may be caused to abut again on the outer periphery of the roll sheet R to feed the sheet 1.

Figure 9:
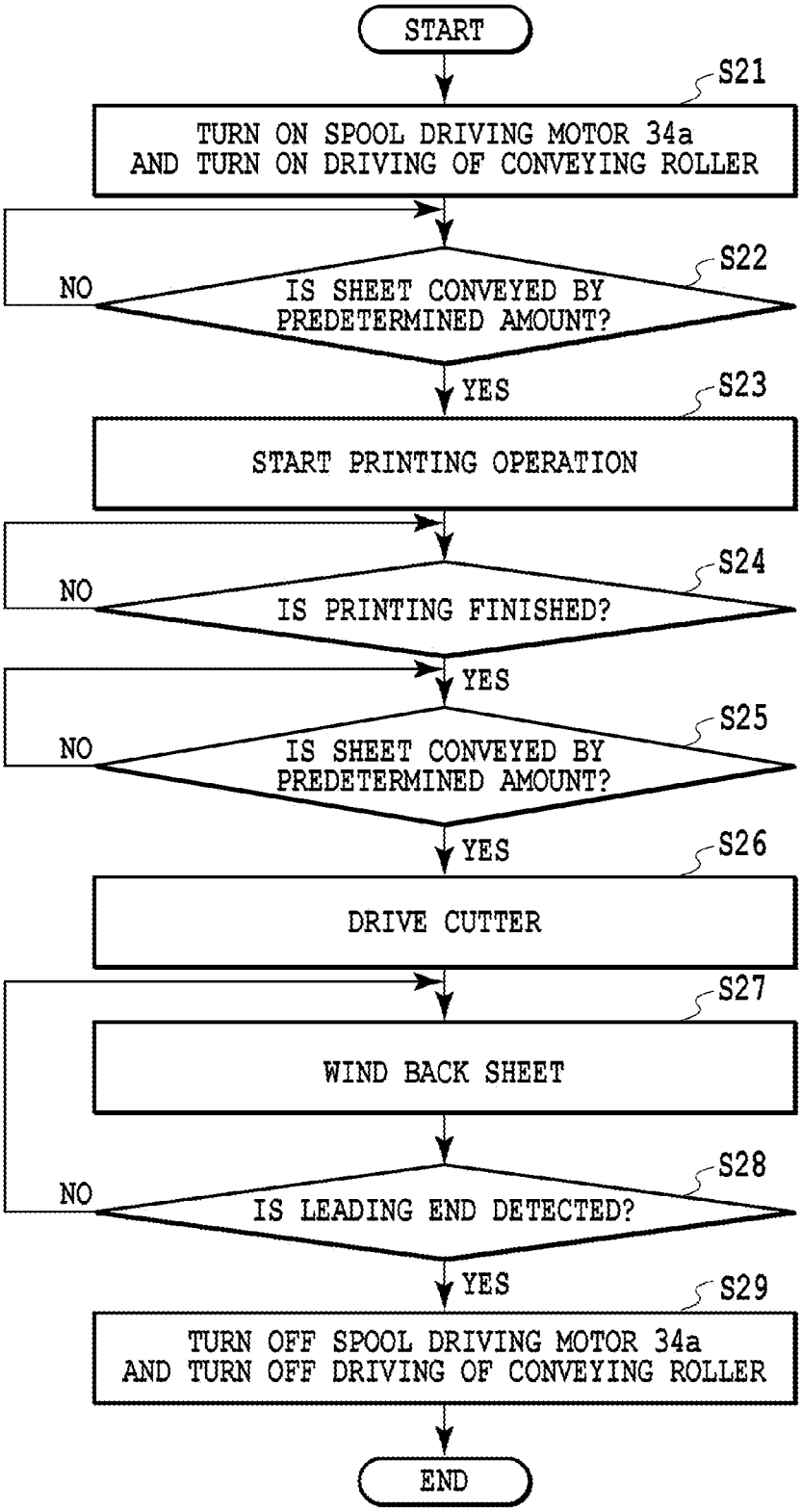
FIG. 9 is a flow chart showing a flow of a printing operation.

FIG. 9 is a flow chart showing a flow of the printing operation. Since the printing operation is started after S17 which is illustrated in FIG. 7, the auxiliary mechanism 200*a* is being separated from the roll sheet R, and the nip force of the pinch roller 11 is the nip force before the skewing correction operation. If print data is received, the CPU 201 starts the present processing, rotates forward the spool driving motor 34*a* and the conveying roller driving motor 35 (S21), and determines whether the sheet 1 is conveyed by a predetermined amount (S22). The predetermined amount means a conveying amount corresponding to a distance between the position of the leading end detection sensor 12 and the position of the print head 15, and a conveying amount by which the leading end of the sheet 1 reaches the position between the print head 15 and the platen 13. If the sheet 1 is not conveyed by the predetermined amount (NO in S22), the determination in S22 is repeated until the sheet 1 is conveyed by the predetermined amount.

If the sheet 1 is conveyed by the predetermined amount (YES in S22), the printing operation is started (S23). Repeating the printing scan of the print head 15 in the x direction and the conveyance of the sheet 1 by the conveying roller 10, thereby an image or the like is printed on the sheet 1. During the printing operation, the spool driving motor 34*a* is rotated backward to avoid a sag of the sheet 1 by applying an appropriate back tension to the sheet 1 and to stably convey the sheet 1. Further, a current flowing through the spool driving motor 34*a* is restricted to suppress the driving force of the spool driving gear 30*a* and the conveying roller 10 is controlled so that the sheet 1 is stretched. In the above, a description has been given of the method for restricting a current flowing through the spool driving motor 34*a* and rotating backward the spool driving motor 34*a*, but the sheet 1 may be conveyed in a state in which a back tension is applied to the sheet 1 by increasing a rotation rate of the conveying roller 10 to a rotation rate which is greater than a rotation rate of the spool shaft 21. In this manner, the method for preventing a warp of the sheet 1 and preventing occurrence of a fold of the sheet or a conveyance error of the sheet is not particularly limited.

Next, the CPU 201 determines whether printing for the received print data is finished (S24). If the printing is not finished (NO in S24), the determination in S24 is repeated until the printing is finished. If the printing is finished (YES in S24), it is determined whether the sheet 1 is conveyed by the predetermined amount, more specifically, whether an end portion of the sheet 1 on which an image is printed has reached the position of the cutter 16 (S25). If the sheet 1 is not conveyed by the predetermined amount (NO in S25), the determination in S25 is repeated until the sheet 1 is conveyed by the predetermined amount. If the sheet is conveyed by the predetermined amount (YES in S25), the rotation of the spool driving motor 34*a* and the conveying roller driving motor 35 is stopped, and the driving motor (not shown) is driven to cut the sheet 1 by the cutter 16 (S26). The cut sheet on which the image is printed is guided by the discharge guide 61 and the guide member 68 and stored in the basket 62. The CPU 201 rotates backward the spool driving motor 34*a* and the conveying roller driving motor 35 to wind back the sheet 1 (S27) and determines whether the leading end of the sheet 1 in the printer 100 is detected by the leading end detection sensor 12 (S28). If the leading end of the sheet 1 is not detected (NO in S28), the sheet 1 is wound back until the leading end of the sheet 1 is detected. If the leading end of the sheet 1 is detected by the leading end detection sensor 12 (YES in S28), the CPU 201 stops the rotation of the spool driving motor 34*a* and the conveying roller driving motor 35 (S29), and the present processing is finished. Then, the printer 100 enters a standby state in which the starting of the next printing operation is awaited.

Figure 10:
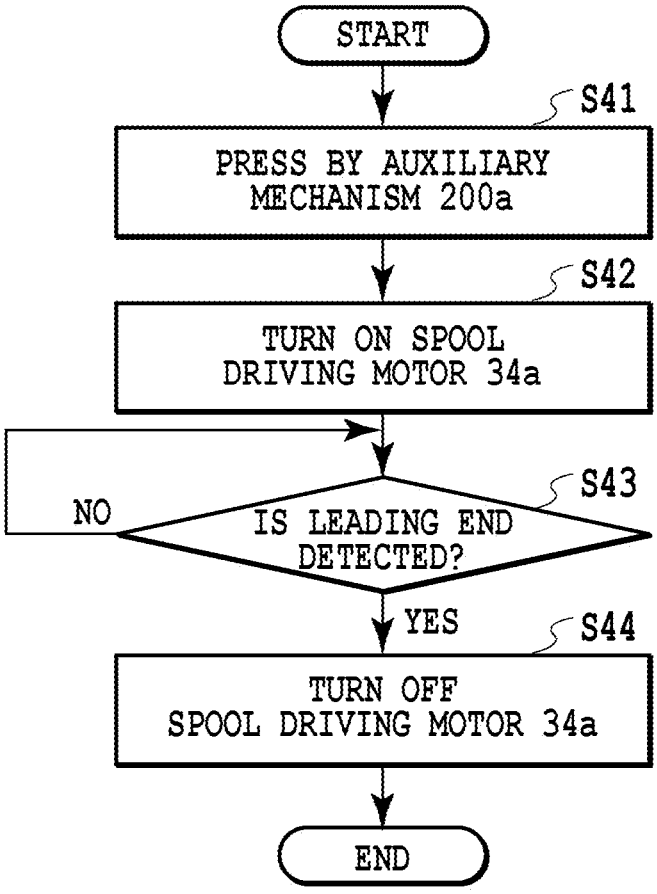
FIG. 10 is a flow chart showing a flow of a winding-back operation of a sheet leading end.

FIG. 10 is a flow chart showing a flow of a winding-back operation in which the leading end of the sheet 1 in the printer 100 is wound back to the position of the leading end detection sensor 301. The winding-back operation described with reference to FIG. 10 is the operation in which the leading end of the sheet 1 located near the conveying roller 10 in the standby state or the like after the processing described with reference to FIGS. 7 and 9 is wound back to the position near supply ports of the roll supply units 70*a* or 70*b*. This winding-back operation is performed, for example, when the roll sheet is replaced or when the roll supply unit used as a supply unit is switched.

If an instruction from the user to replace the roll sheet or an instruction from the user to switch the supply unit is inputted to the CPU 201, the present processing is started, and the CPU 201 rotates forward the driving motor 33*a* and causes the auxiliary mechanism 200*a* to press the roll sheet R (S41). Then, the spool driving motor 34*a* is rotated backward (S42). Since the processing of FIGS. 7 and 9 is finished after the leading end of the sheet 1 is detected by the leading end detection sensor 12, only the spool driving motor 34*a* is rotated backward in this example. However, if the present processing is started from the state in which the leading end of the sheet 1 is yet to be detected by the leading end detection sensor 12, not only the spool driving motor 34*a* but also the conveying roller driving motor 35 is rotated backward in S42. In this case, if the leading end of the sheet 1 is detected by the leading end detection sensor 12, the rotation of the conveying roller driving motor 35 is stopped.

The CPU 201 determines whether the leading end of the sheet 1 wound back in the upstream side in the feeding direction by the rotation of the spool member 2*a* is detected by the leading end detection sensor 301*a* (S43). If the leading end of the sheet 1 is not detected (NO in S43), the processing in S43 is repeated until the leading end of the sheet 1 is detected. If the leading end of the sheet 1 is detected (YES in S43), the rotation of the spool driving motor 34*a* is stopped (S44), and the winding-back operation herein is finished.

If the leading end of the sheet is wound to the roll unit for the purpose of replacing the roll sheet or the like, the spool driving motor 34*a* may be rotated for a predetermined time even after the leading end of the sheet is detected by the leading end detection sensor 301*a*, and the sheet may be wound back until the leading end of the sheet is released from the conveying guide 8. Meanwhile, if the roll supply unit to be used for the supply function is switched, for example, the rotation of the spool driving motor 34*a* may be stopped immediately after the sheet is detected by the leading end detection sensor 301*a*, and a state in which the leading end of the sheet is located in proximity to the leading end detection sensor 301*a* may be maintained. At this time, the state in which the auxiliary mechanism 200*a* is pressing the roll sheet is maintained, and the sheet is prevented from dropping from the conveying guide 8 under its own weight. Accordingly, if the roll supply unit used as a supply unit is switched again, for example, it is possible to omit an operation of inserting the leading end of the sheet to the conveying guide 8.

A description will be given of the case where the roll supply unit 70*b* is used as a winding unit. FIG. 11 is a schematic cross-sectional view showing a configuration of the printer 100 when a sheet is wound. In this example, the roll supply unit 70*b* is used as a winding unit. Other configurations are the same as those described with reference to FIG. 2, so a description thereof will be omitted. As shown in FIG. 11, the paper tube 17 is set on the spool member 2*b* of the roll supply unit 70*b*, and the leading end of the sheet 1 supplied from the roll supply unit 70*a* is wound around the paper tube 17.

As shown in FIG. 11, if a sheet is wound, the guide member 68 and the basket 62 are being housed not to interfere with the winding operation. Accordingly, the winding operation is performed when the position detection sensor 67 is placed OFF without detection of the rod 63*b* and the position detection sensor 69 is placed ON with detection of the guide member 68.

Figure 12A:
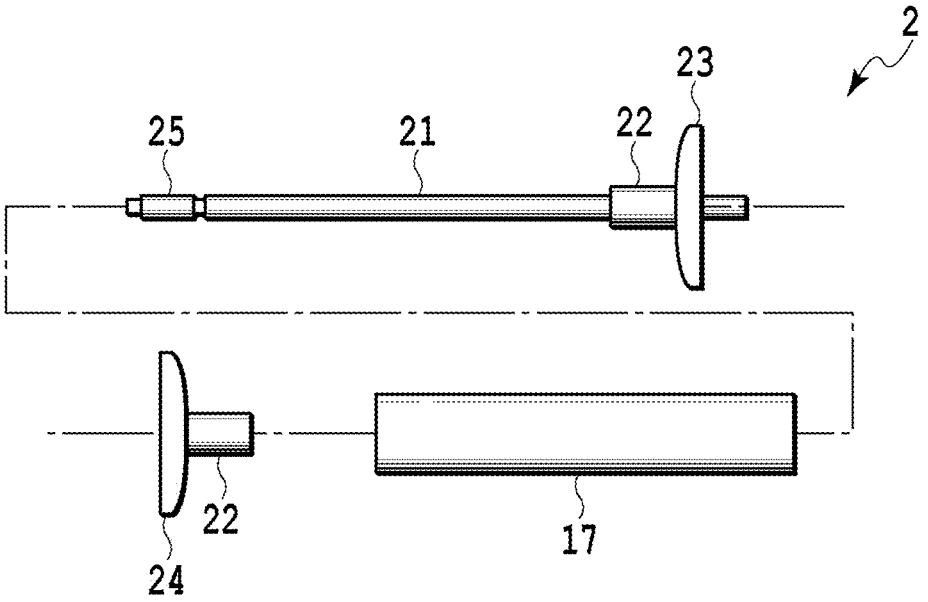
FIGS. 12A and 12B are views illustrating a method for setting a paper tube.
Figure 12B:
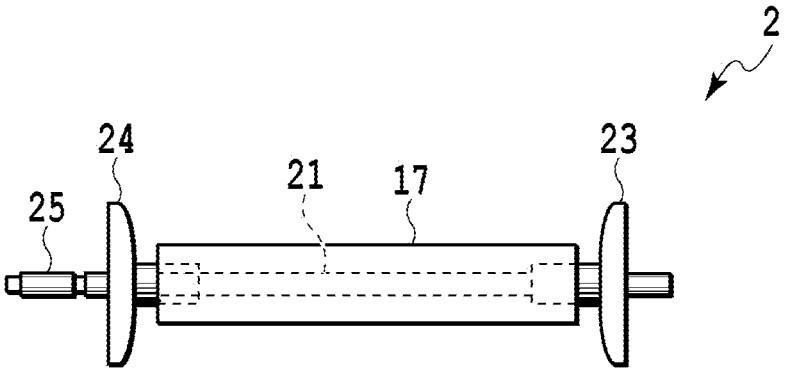

FIGS. 12A and 12B are views illustrating a method for setting the paper tube 17. The paper tube 17 is set on the spool member 2 by the same method as the one for setting the roll sheet R as described with reference to FIGS. 4A to 4C. That is, in the above-described method, the paper tube 17 is set on the spool member 2 by replacing the roll sheet R with the paper tube 17.

Figure 13A:
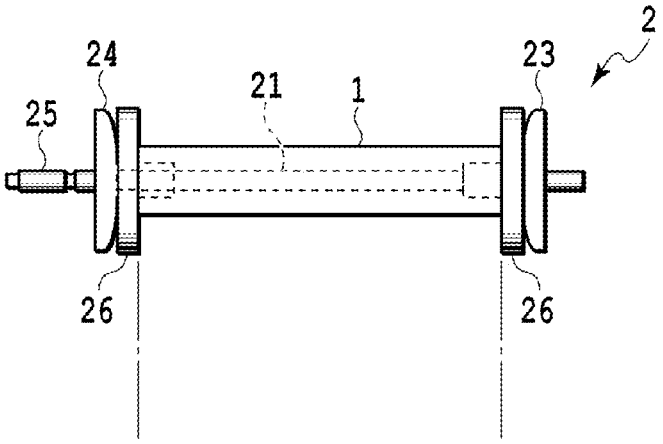
FIGS. 13A and 13B are views for comparing spool members.
Figure 13B:
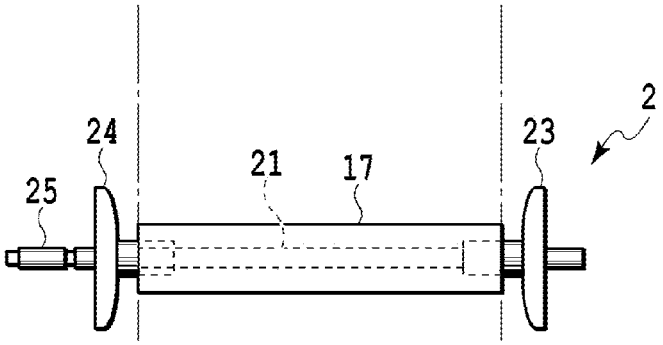

FIGS. 13A and 13B are views for comparing spool members 2. FIG. 13A shows a configuration of the spool member 2 at the time of supply and FIG. 13B shows a configuration of the spool member 2 at the time of winding. As shown in FIGS. 13A and 13B, as opposed to the spool member 2 at the time of supply, the flange attachment 26 is not attached to the spool member 2 at the time of winding. As described above, the flange attachment 26 may be detached from the reference spool flange 23 and the non-reference spool flange 24. Accordingly, in a case where the spool member 2 which has been used for supply is used for winding, the flange attachment 26 is detached, and in a case where the spool member 2 which has been used for winding is used for supply, the flange attachment 26 is attached.

As shown in FIG. 13A, a contact surface between the flange attachment 26 and an end portion of the sheet 1 is a flat surface, and an end portion of the roll sheet R in the width direction abuts against the flat surface to be positioned in the width direction. In this example, the flange attachment 26 having the flat surface is attached to both of the reference spool flange 23 and the non-reference spool flange 24. However, a facing surface between the flange attachment 26 attached to the non-reference spool flange 24 and the end portion of the sheet 1 does not need to be the flat surface. Further, the flange attachment 26 does not need to be attached to the non-reference spool flange 24. That is, the contact surface between the flange attachment 26 attached to the reference spool flange 23 and the sheet 1 only needs to be the flat surface.

As shown in FIG. 13B, since the flange attachment 26 is not attached at the time of winding, the interspace between the reference spool flange 23 and the non-reference spool flange 24 is greater by a distance corresponding to the flange attachment 26, and the distance between the reference spool flange 23 and the non-reference spool flange 24 is greater than the width of the sheet 1. The surfaces of the reference spool flange 23 and the non-reference spool flange 24 that are facing the end portions of the sheet 1 respectively are tapered, thereby the skewing of the wound sheet can be acceptable to some extent.

Figure 14:
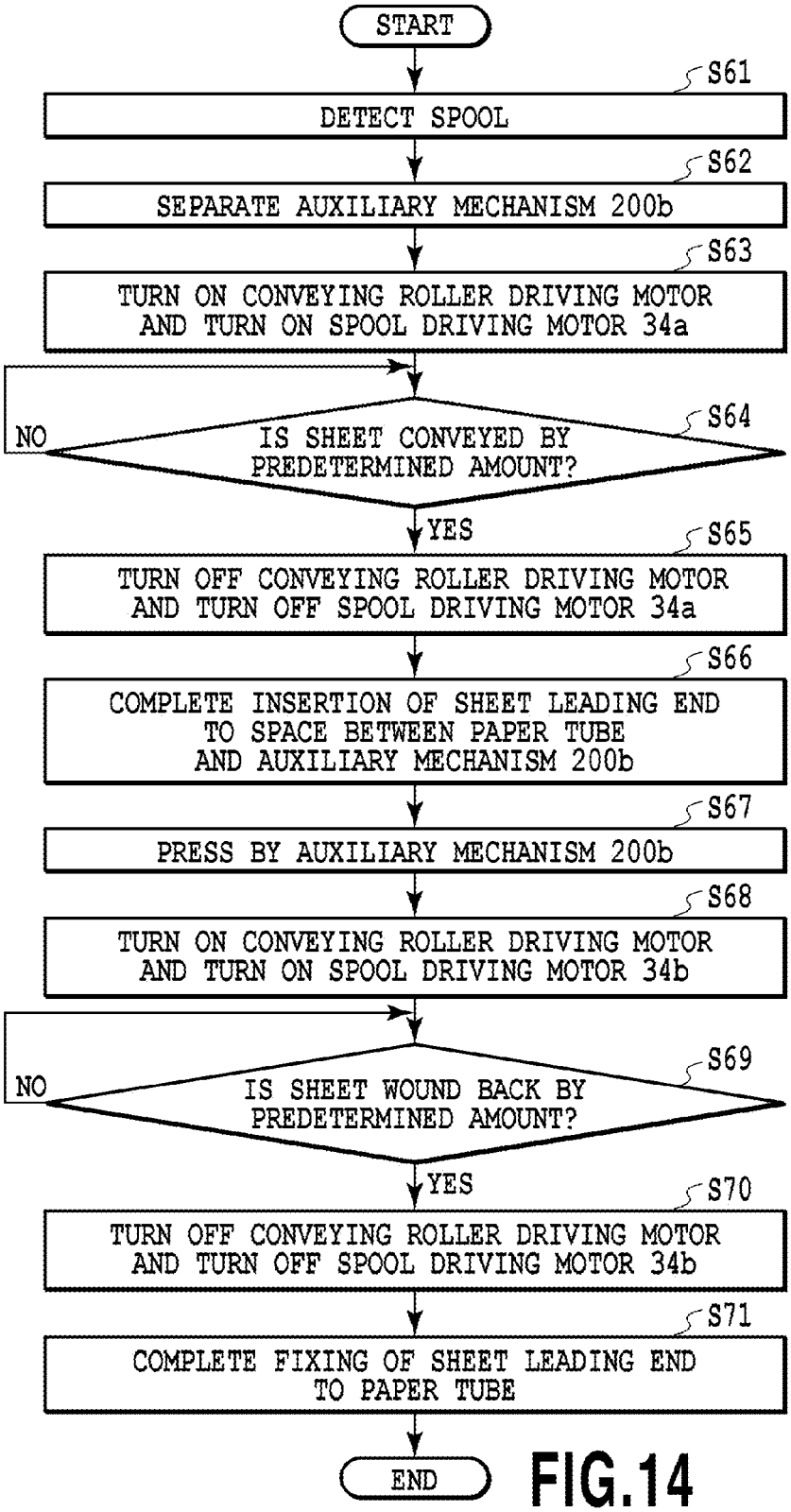
FIG. 14 is a flow chart showing a flow of a setting operation of a paper tube.

FIG. 14 is a flow chart showing a flow of a setting operation of the paper tube 17 before the starting of the winding operation. It should be noted that a description will be given of the case where the roll supply unit 70*a* is used as a supply unit and a winding mode is selected to use the roll supply unit 70*b* as a winding unit according to the operation of the operation panel 20 by the user. Other than the winding mode, a discharge mode in which the sheet is discharged to the basket can be selected.

In FIG. 14, a description will be given of the processing performed after the sheet 1 is supplied from the upper roll supply unit 70*a* and when the starting of the printing operation is awaited according to the flow of the processing described with reference to FIG. 7. The present processing is started if the user selects the winding mode.

If the user sets the spool member 2 in which the paper tube 17 is set on the spool holder 31 of the roll supply unit 70*b*, the existence of the spool member 2*b* is detected by the spool detection sensor 32 (S61). If the detection signal is inputted to the CPU 201, the CPU 201 rotates backward the driving motor 33 and separates the auxiliary mechanism 200*b* from the spool member 2*b* (S62). The CPU 201 rotates forward the conveying roller driving motor 35 and the spool driving motor 34*a* (S63), supplies the sheet 1 from the roll supply unit 70*a*, and conveys the sheet 1.

The CPU 201 determines whether the sheet 1 is conveyed by a predetermined amount (S64). The predetermined amount is an amount corresponding to a length as the sheet is warped in a state in which the leading end of the sheet 1 is inserted into the space between the paper tube 17 and the auxiliary mechanism 200*b*. If the sheet 1 is not conveyed by the predetermined amount (NO in S64), the CPU 201 repeats the determination in S64 until the sheet 1 is conveyed by the predetermined amount. If the sheet 1 is conveyed by the predetermined amount (YES in S64), the CPU 201 stops the rotation of the conveying roller driving motor 35 and the spool driving motor 34*a* (S65). Then, the CPU 201 sends an instruction to the user to insert the leading end of the sheet 1 into the space between the paper tube 17 and the auxiliary mechanism 200*b* by displaying the message on the operation panel 20 or the like. If the CPU 201 recognizes that the operation according to the instruction is completed by the operation by the user (S66), the CPU 201 rotates forward the driven motor 33*b* and causes the auxiliary mechanism 200*b* to press the paper tube 17 (S67). Further, the CPU 201 rotates backward the conveying roller driving motor 35 and rotates forward a spool driving motor 34*b* (S68). In this example, a friction force generated between the conveying roller 10 and the sheet 1 is set higher than a friction force generated between the paper tube 17 and the sheet 1. Therefore, even if the two motors are rotated in opposite directions, the sheet 1 is wound back. Further, in this state, a tension is given to the sheet 1, and accordingly warping of the sheet 1 is removed, and skewing is corrected even if skewing is generated in the sheet 1.

The CPU 201 determines whether the sheet 1 is wound back by a predetermined amount (S69). The predetermined amount means an amount by which the sheet 1 does not drop from the space between the paper tube 17 and the auxiliary mechanism 200*b*. If the sheet is not wound back by the predetermined amount (NO in S69), the determination in S69 is repeated until the sheet 1 is wound back by the predetermined amount. If the sheet 1 is wound back by the predetermined amount (YES in S69), the rotation of the conveying roller driving motor 35 and the spool driving motor 34*b* is stopped (S70). The CPU 201 displays the message on the operation panel 20 or the like and sends an instruction to the user to fix the leading end of the sheet 1 to the paper tube 17. If the CPU 201 recognizes that the operation according to the instruction is completed by the operation by the user (S71), the present processing is finished. Then, the printer 100 enters a standby state in which the starting of the next printing operation is awaited.

Figure 15:
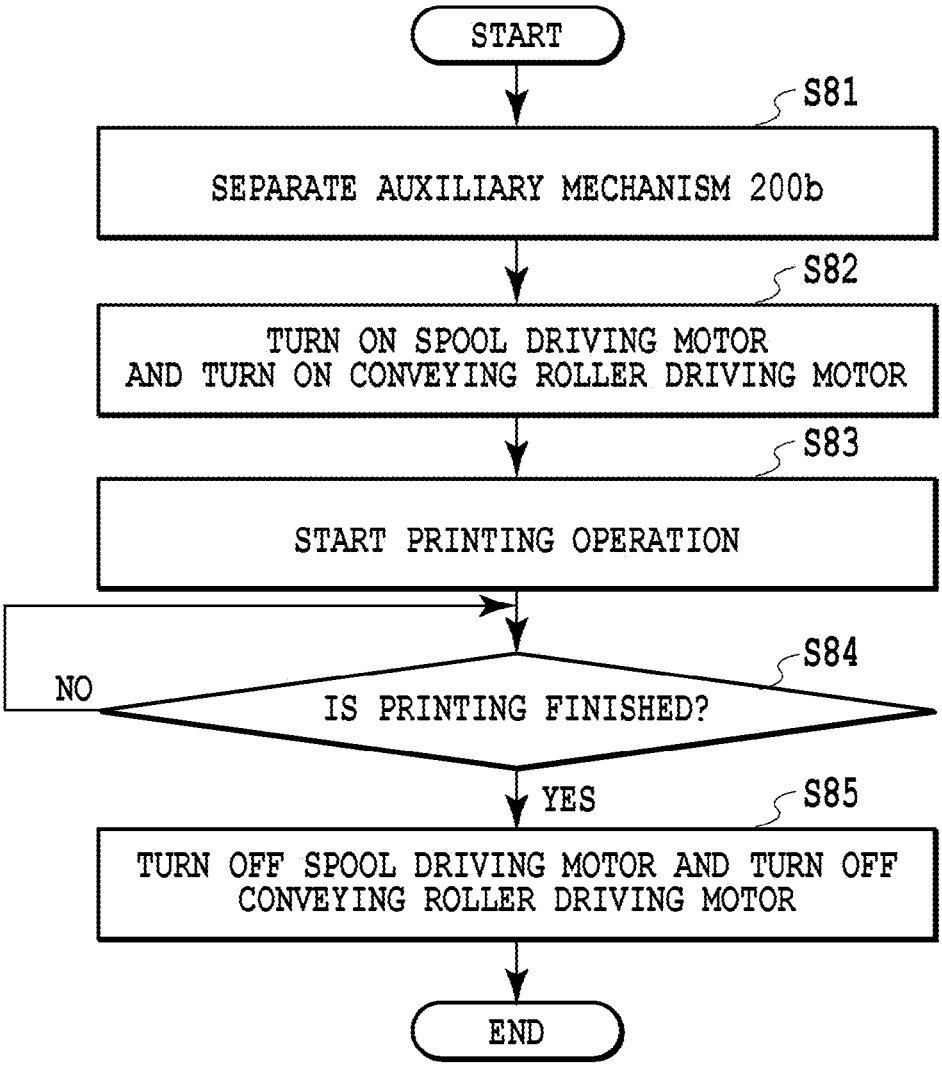
FIG. 15 is a flow chart showing a flow of a printing operation in a winding mode.

FIG. 15 is a flow chart showing a flow of a printing operation in a winding mode. Since the printing operation is started after S71 illustrated in FIG. 14, the auxiliary mechanism 200*b* is pressing the sheet 1 against the paper tube 17. If the CPU 201 receives print data, the present processing is started, and the CPU 201 rotates backward the driving motor 33*b* and separates the auxiliary mechanism 200*b* from the paper tube 17 (S81). The CPU 201 rotates forward the spool driving motor 34*a* and the conveying roller driving motor 35 and rotates backward the spool driving motor 34*b* (S82) to start the printing operation (S83). During the printing operation, like the method illustrated in FIG. 7, by restricting a current flowing through the spool driving motor 34*a* and rotating backward the spool driving motor 34*a*, the sheet 1 is conveyed in a state in which a back tension is applied to the sheet 1.

In the winding operation of the sheet 1, the spool driving motor 34*b* is also driven with the conveying roller driving motor 35. More specifically, along with the conveying operation by the conveying roller 10, the spool driving motor 34*b* is driven in the opposite direction to wind up the sheet 1. At this time, a current flowing through the spool driving motor 34*b* is restricted and the spool driving motor 34*b* is controlled not to stretch the sheet 1 at a predetermined torque (tension) or greater. This can achieve stable conveyance.

The CPU 201 determines whether printing for the received print data is finished (S84). If the printing is not finished (NO in S84), the determination in S84 is repeated until the printing is finished. If the printing is finished (YES in S84), the rotation of the spool driving motor 34 and the conveying roller driving motor 35 is stopped (S85), and the present processing is finished. Then, the printer 100 enters a standby state in which end processing is awaited.

Figure 16:
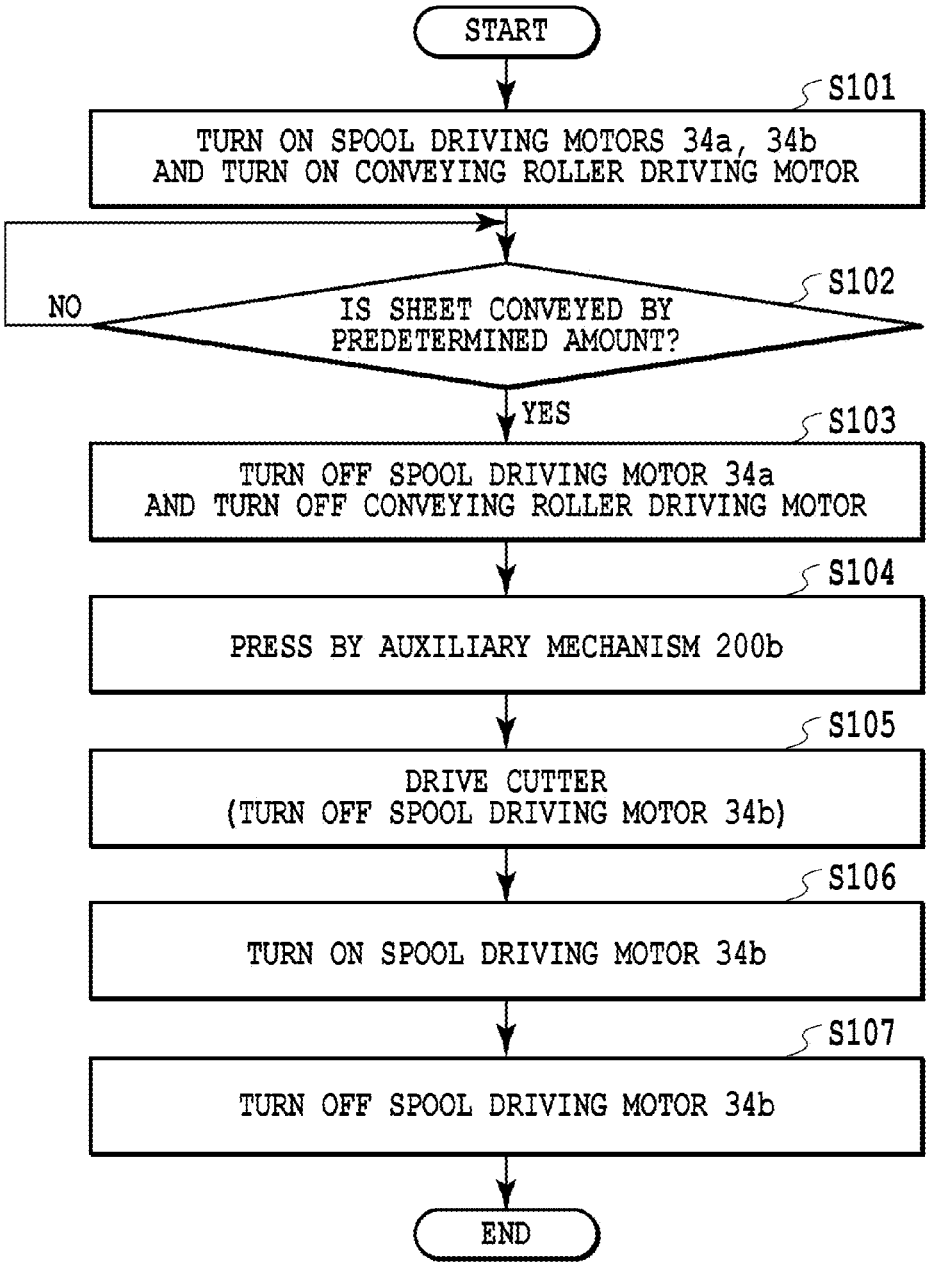
FIG. 16 is a flow chart showing a flow of sheet end processing in the winding mode.

FIG. 16 is a flow chart showing a flow of end processing in the winding mode. If an instruction to perform the end processing from the user is inputted to the CPU 201, the CPU 201 starts the present processing, rotates forward the conveying roller driving motor 35 and the spool driving motor 34*a*, and rotates backward the spool driving motor 34*b* to convey and wind up the sheet 1 (S101). The CPU 201 determines whether the sheet 1 is conveyed by the predetermined amount (S102). If the sheet is not conveyed by the predetermined amount (NO in S102), the sheet 1 is conveyed until the sheet 1 is conveyed by the predetermined amount. If the sheet 1 is conveyed by the predetermined amount (YES in S102), the rotation of the conveying roller driving motor 35 and the spool driving motor 34*a* is stopped (S103), and the CPU 201 rotates forward the driving motor 33*b* and causes the auxiliary mechanism 200*b* to press the sheet against the paper tube 17 (S104).

At this time, when the driven rotors 6 and 7 come into contact with a portion of the sheet 1 to which ink is applied, the ink applied to the sheet 1 may be transferred to other portions via the driven rotors 6 and 7. Therefore, it is preferable to cause the auxiliary mechanism 200*b* to abut on the sheet 1 after the sheet 1 is wound around the paper tube 17 to the position at which the portion to which ink is applied does not come into contact with the driven rotors 6 and 7. To avoid transfer, ink may be dried before the auxiliary mechanism 200*b* abuts on the sheet 1, or the surfaces of the driven rotors 6 and 7 may be subjected to a fluorine coating or the like.

In a state in which the auxiliary mechanism 200*b* is pressing the sheet 1 against the paper tube 17, the rotation of the spool driving motor 34*b* is temporarily stopped, and the sheet 1 is cut by the cutter 16 operated by a cutter driving motor (not shown) (S105). It should be noted that in cutting the sheet 1, the end of the sheet 1 toward the roll supply unit 70*b* is held by the user, for example, so as to prevent the end of the sheet 1 from dropping. Then, the spool driving motor 34*b* is rotated again, and the end of the cut sheet 1 is wound around the paper tube 17 (S106). The rotation of the spool driving motor 34*b* is stopped at a predetermined timing (S107). As a result of the operation by the user, the end of the cut sheet 1 is fixed to the paper tube 17 by using a tape or the like, and the present processing is finished.

In the configuration without using the auxiliary mechanism 200*b*, the sheet may be loosened unless, when cut, the sheet 1 is held stretched not to be sagged. If the sheet is loosened, the surface to which ink is applied could possibly be scratched when the sheet is wound tight. To avoid this, in this example, as described above, in the processing in S103 and the following steps, the auxiliary mechanism 200*b* is pressing the sheet 1 against the paper tube 17. Accordingly, if there is a sag between the end of the sheet held by the user's hand and the sheet pressed by the auxiliary mechanism 200*b* in the cut sheet 1, the wound sheet will not be loosened. That is, assisting not only the supply operation but also the winding operation by using the auxiliary mechanism 200 allows the sheet to be reliably wound around the paper tube.

As described above, using the movable guide member 68 allows preventing the discharged sheet from entering the roll supply unit 70 and preventing the guide member 68 from interfering with the operation when the roll sheet or the like is set or in the winding operation. Further, forming the discharge guide 61 as a movable member allows preventing the discharge guide 61 from interfering with the operation when the roll sheet or the like is set. Furthermore, the selected control mode is compared with the state of the printer 100, and whether they match is determined and notified to the user, so as to avoid an event that could possibly occur if they do not match.

Second Embodiment

In the present embodiment, as members corresponding to the discharge guide 61 and the guide member 68 of the first embodiment, roll covers 80 and 81 and a guide member 82 are used. Other configurations are the same as those of the first embodiment, so a description thereof will be omitted. Here, the roll cover 80 and the guide member 82 constitute a guide unit.

Figure 18A:
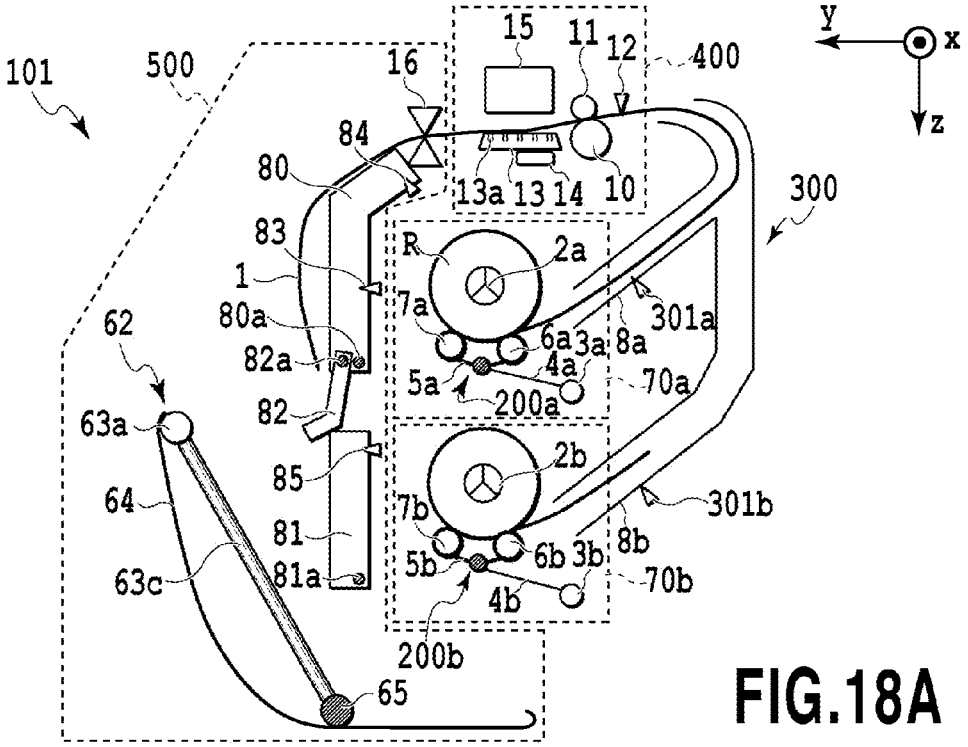
FIGS. 18A and 18B are schematic cross-sectional views of the printing apparatus of the second embodiment.
Figure 18B:
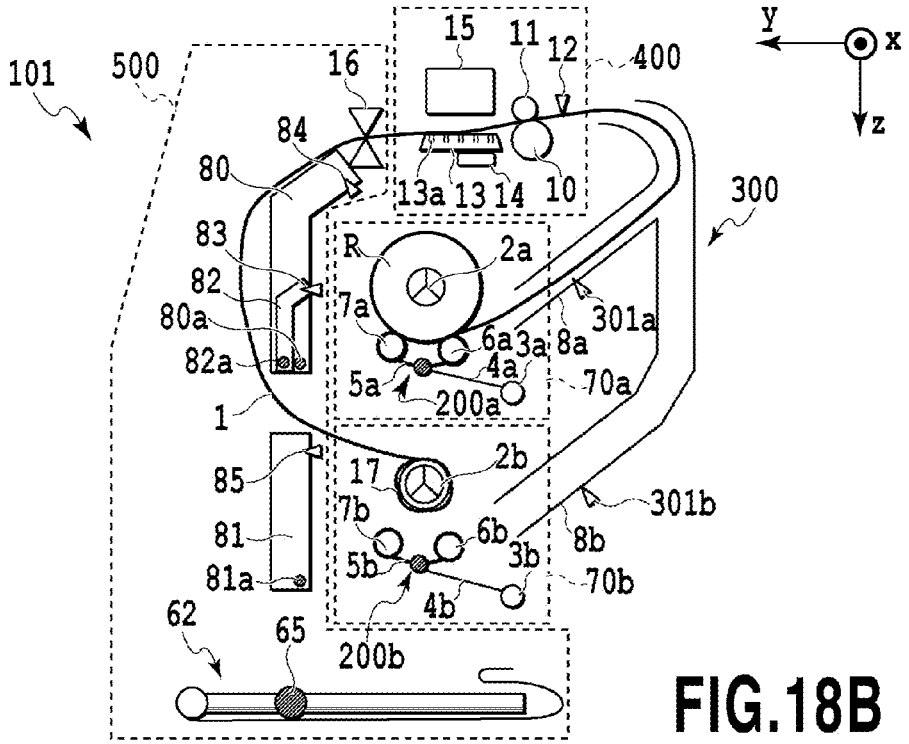

FIGS. 17A and 17B are perspective views showing a printer 101 of the present embodiment. FIGS. 18A and 18B are schematic cross-sectional views showing the printer 101. Both units of a roll supply unit 70 in FIGS. 17A and 18A are used as supply units. FIGS. 17B and 18B show a roll supply unit 70*a* as a supply unit and a roll supply unit 70*b* as a winding unit, respectively.

As shown in FIGS. 17A, 17B, 18A, and 18B, the roll cover 80 is arranged in a position in which a roll sheet R set on the roll supply unit 70*a* can be covered. The roll cover 81 is arranged in a position in which the roll sheet R or a paper tube 17 set on the roll supply unit 70*b* can be covered.

The roll cover 80 can be rotated around a pivot 80*a* shown in FIGS. 18A and 18B. The roll cover 81 can be rotated around a pivot 81*a* shown in FIGS. 18A and 18B. When the roll sheet R or the like is set on the roll supply unit 70, the roll covers 80 and 81 are rotated in a counterclockwise direction as viewed from the front in the figures and the roll covers 80 and 81 are retracted into a position in which the roll covers 80 and 81 do not interfere with the setting operation. After setting, the roll covers 80 and 81 are rotated in a clockwise direction as viewed from the front in the figures to a position in which the roll sheet R or the like can be covered. A position detection sensor 84 outputs a detection signal when the roll cover 80 is arranged in a position in which the roll sheet R or the like can be covered, and a position detection sensor 85 outputs a detection signal when the roll cover 81 is arranged in a position in which the roll sheet R or the like can be covered.

Further, at a portion below the roll cover 80 in a z direction, a guide member 82 is attached. The guide member 82 is a movable guide member that can move to one of a position at which the guide member 82 leads the sheet 1 guided by the roll cover 80 toward a basket 62 and a position at which the guide member 82 is housed in the roll cover 80, and the guide member 82 can rotate around a pivot 82*a*.

As shown in FIG. 18A, in a state in which the guide member 82 is located in a position for guiding the sheet 1, the guide member 82 has a bending portion that bends to cause the discharged sheet 1 to move toward a bag portion configured by a cloth member 64. Further, in the state shown in FIG. 18A, the guide member 82 and the roll cover 81 are configured not to have a gap therebetween which a sheet enters. In this manner, even in the configuration in which the bag portion of the cloth member 64 does not have a portion 64*c* as shown in FIGS. 3A to 3C, the shape and arrangement of the guide member 82 can guide the sheet 1 toward the bag portion of the cloth member 64.

A position detection sensor 83 outputs a detection signal when the guide member 82 is located in a position in which the guide member 82 is housed in the roll cover 80. If both units of the roll supply unit 70 are used as supply units, the roll cover 80, the guide member 82, and the roll cover 81 guide the sheet 1 toward the basket 62. This can prevent the sheet 1 from entering the roll supply unit 70. In this example, therefore, rods 63*b* and 63*d*, the portion 64*c* of the cloth member 64, and the position detection sensor 67 of the first embodiment as shown in FIGS. 1 to 3 and the like are not provided. If the roll supply unit 70*b* is used as a winding unit, the guide member 82 is housed in the roll cover 80 as shown in FIGS. 17B and 18B.

Figure 19A:
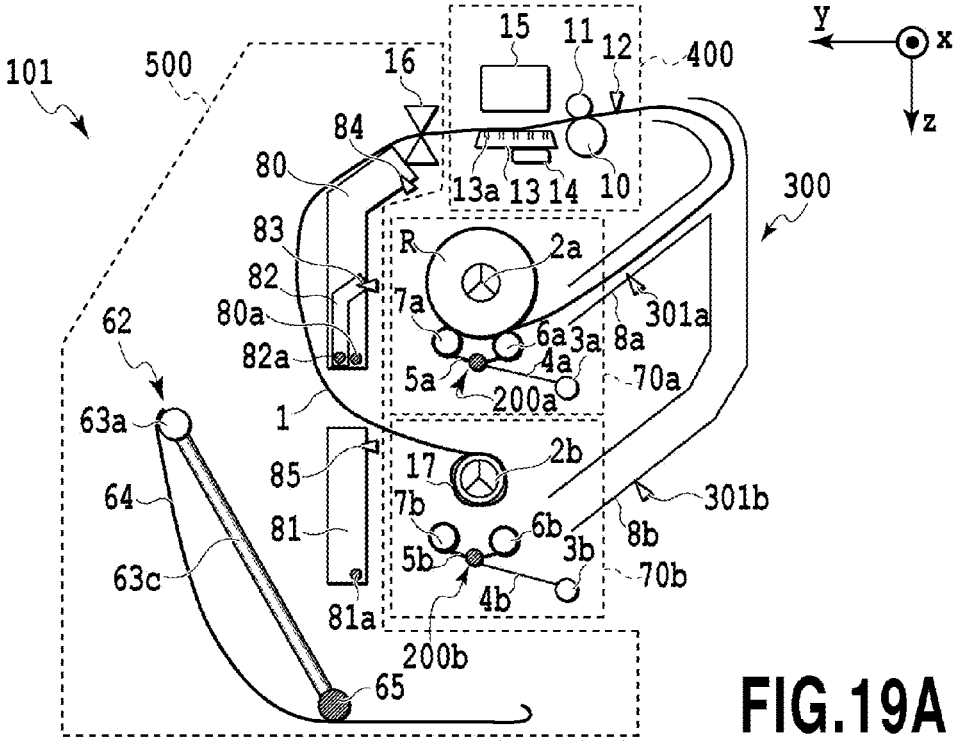
FIGS. 19A and 19B are schematic cross-sectional views of the printing apparatus of the second embodiment.
Figure 19B:
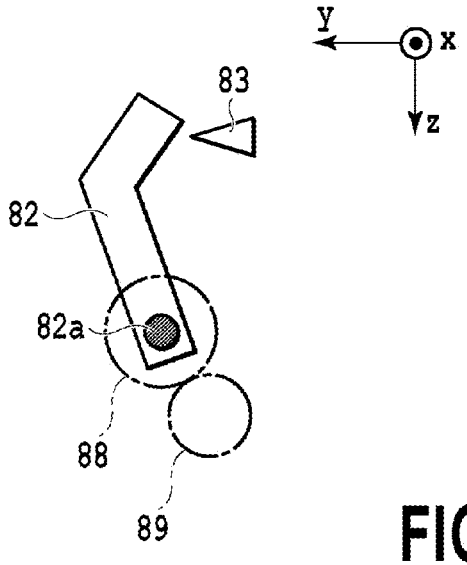

FIGS. 19A and 19B are views illustrating a configuration of the printer 101 in a case where the roll supply unit 70*b* is used as a winding unit without housing the basket 62. FIG. 19A is a schematic cross-sectional view of the printer 101 and FIG. 19B shows a configuration around the guide member 82. In this example, without operating the basket 62 to be housed from the state shown in FIG. 18A, the roll supply unit 70*b* is used as a winding unit as shown in FIG. 19A.

The guide member 82 is rotatably attached to the pivot 82*a*, and as shown in FIGS. 17A and 17B, in this example, three guide members 82 are attached to the roll cover 80. As shown in FIG. 19B, a driving gear 88 is attached to one end of the pivot 82*a*, and the pivot 82*a* is coupled to a driving motor 89 via the driving gear 88. In this example, the switching between a supply function and a winding function is performed by a CPU 201 to control the driving motor 89 based on user's selection to switch the position of the guide members, and by the user to set a paper tube 17. Further, as shown in FIGS. 17A and 17B, the rod 63*b* or the like shown in FIG. 1 and the like is not provided. In this example, therefore, as shown in FIG. 19A, as long as the guide member 82 is housed, even if the basket 62 is not housed, the roll supply unit that has been used as a supply unit may be used as a winding unit.

As described above, using the movable guide member can lead a sheet to a desirable position and using the movable roll cover can prevent these members from interfering with the operation when the roll sheet is set or the like.

Third Embodiment

In the present embodiment, a discharge guide 90 is used as a member corresponding to the discharge guide 61 and the guide member 68 of the first embodiment. Other configurations are the same as those described in the first embodiment, so a description thereof will be omitted. Here, the discharge guide 90 constitutes a guide unit.

Figure 20A:
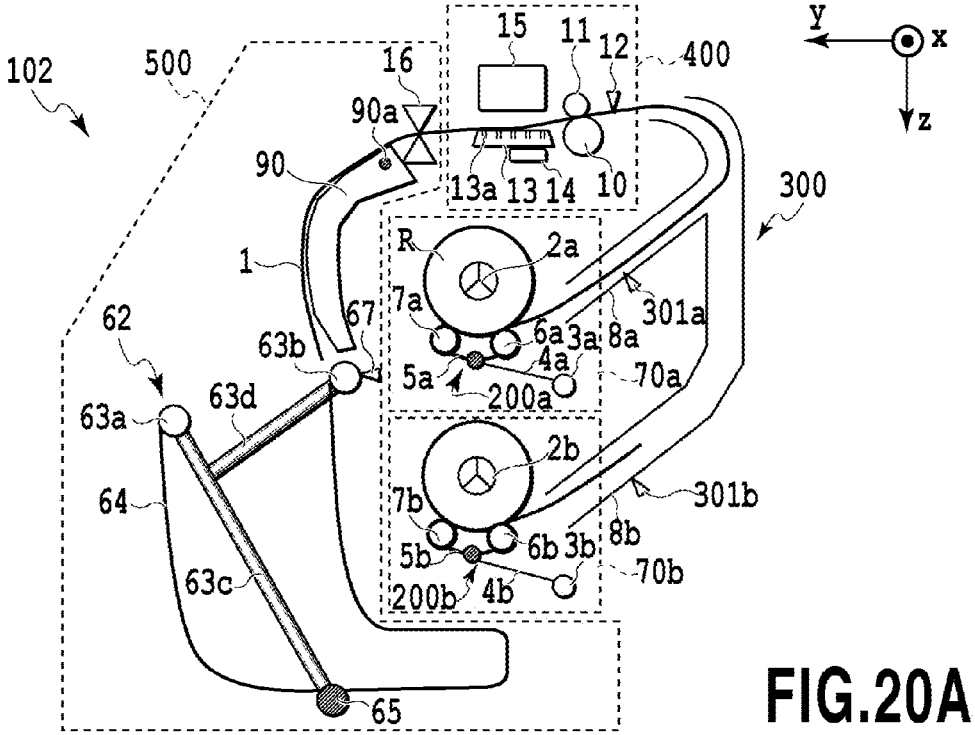
FIGS. 20A and 20B are schematic cross-sectional views of a printing apparatus of a third embodiment.
Figure 20B:
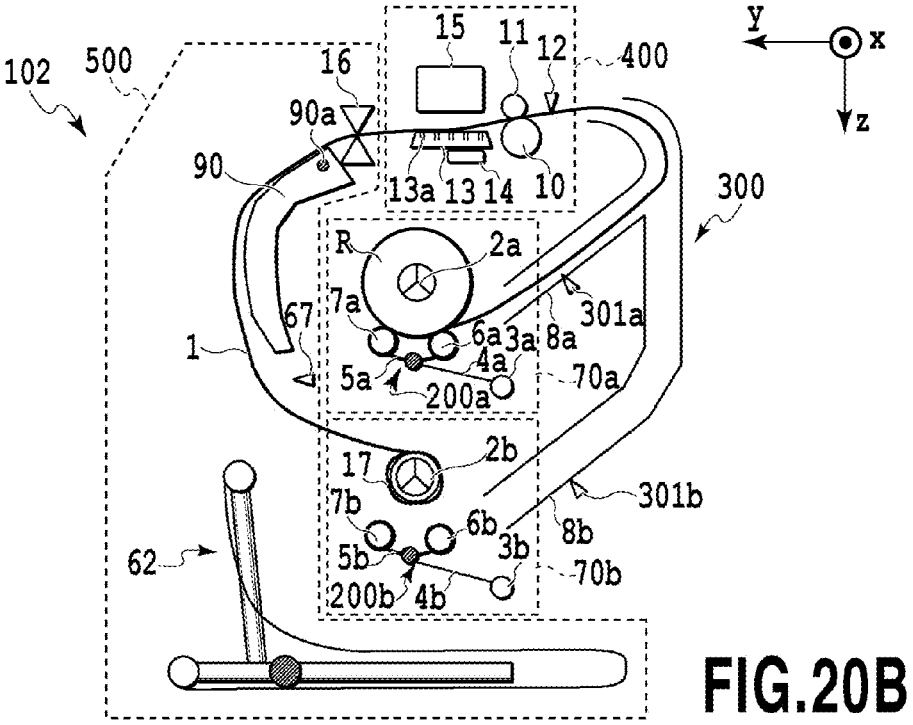

FIGS. 20A and 20B are schematic cross-sectional views of a printer 102 of the present embodiment. FIG. 20A shows the case where both units of a roll supply unit 70 are used as supply units. FIG. 20B shows the case where a roll supply unit 70*a* is used as a supply unit and a roll supply unit 70*b* is used as a winding unit.

If FIGS. 20A and 20B are compared with FIG. 2, the discharge guide 90 has a size corresponding to a size combining the discharge guide 61 and the guide member 68 in a z direction. A sheet 1 is guided by the discharge guide 90 toward a basket 62 or the roll supply unit 70*b*. In this manner, in this example, a member guiding a sheet toward the basket 62 or the roll supply unit is constituted by one member, namely, the discharge guide 90. Accordingly, as compared to the configuration in which the discharge guide 61 and the guide member 68 are formed as separate members as in the first embodiment, there is no need to have a housing operation or a pulling operation of the guide member 68 or to provide a position detection sensor 69 or the like.

As shown in FIGS. 20A and 20B, in this example, in both of a discharge mode (supply mode) and a winding mode, the arrangement of the discharge guide 90 is not changed. That is, either in supplying or winding, the discharge guide 90 is located in the same position. Even in this case, as shown in FIG. 20A, the size of the discharge guide 90 and a positional relation between the discharge guide 90 and a cloth member 64 are set so that a discharged sheet will not enter a space between the discharge guide 90 and the cloth member 64. Furthermore, in this example, as shown in FIG. 20B, a sheet can be wound by closing the basket 62 even without moving the discharge guide 90.

Further, the discharge guide 90 can rotate around a shaft 90*a* in a clockwise direction and a counterclockwise direction as viewed from the front in the figures. In the present embodiment, therefore, the discharge guide 90 can be retracted into a position in which it does not interfere with a user operation when a roll sheet R is set on the upper roll supply unit 70*a* or the like.

In this manner, in this example, a sheet may be guided to a desirable position depending on whether to open or close the basket 62. Further, using the movable discharge guide 90 can prevent the discharge guide 90 from interfering with the setting operation of the roll sheet or the like.

Fourth Embodiment

In the present embodiment, a roller pair is used instead of the auxiliary mechanism 200. Other configurations are the same as those described in the first embodiment, so a description thereof will be omitted.

Figure 21:
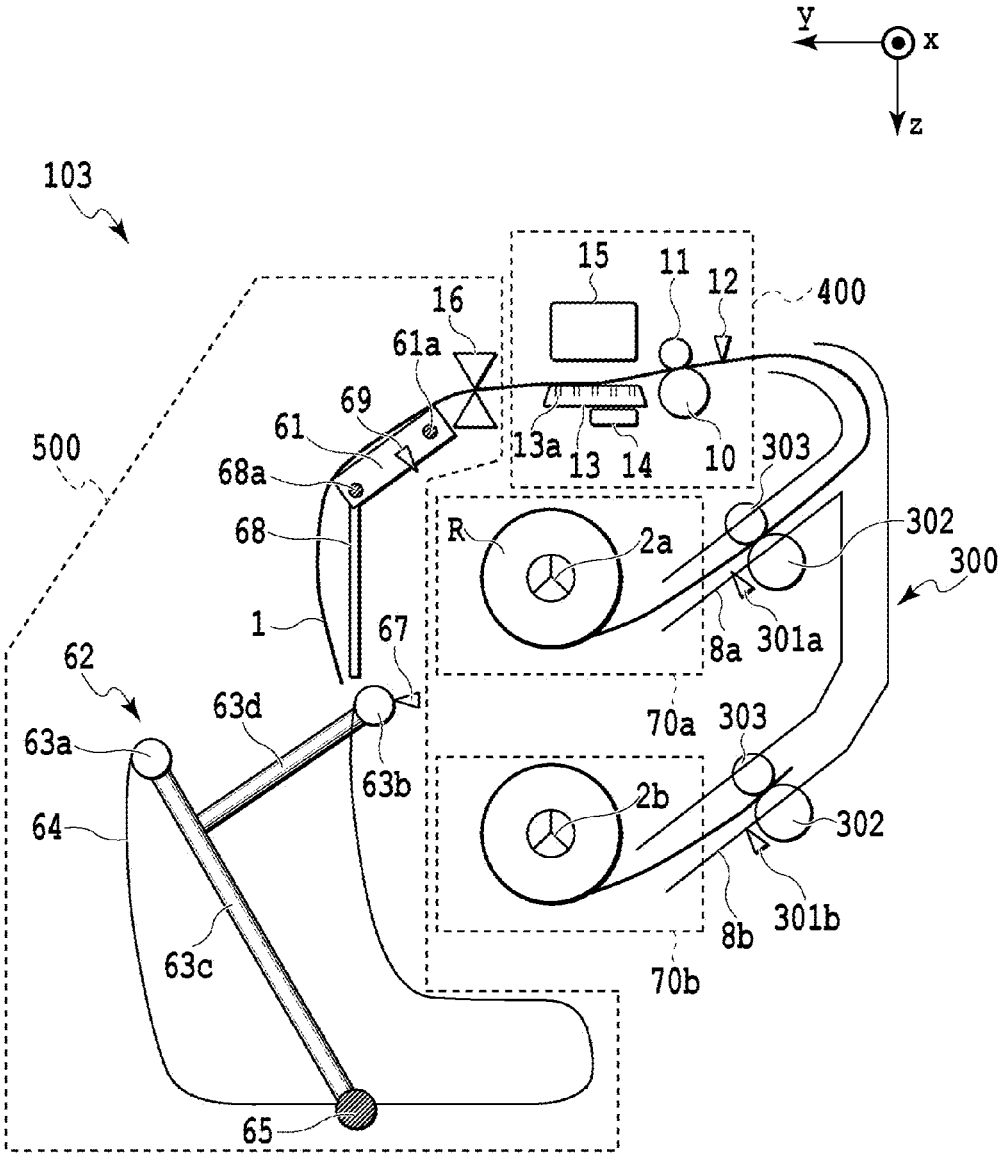
FIG. 21 is a schematic cross-sectional view of a printing apparatus of a fourth embodiment.

FIG. 21 is a schematic cross-sectional view of a printer 103 of the present embodiment. As shown in FIG. 21, in this example, a roller pair configured by rollers 302 and 303 is provided in a position near an entry of a conveying guide 8 and upstream of a conveying roller 10 and a pinch roller 11 in a supply direction. The roller 302 is driven by a driving motor (not shown), and the roller 303 is driven to rotate by the rotation of the roller 302. In this configuration, when a user sets a roll sheet R, the roll sheet R is rotated, and a leading end of a sheet 1 is inserted into a space between the roller pair to have the sheet 1 sandwiched between the roller pair. Setting a rotation rate of a driving motor which drives the roller 302 greater than a rotation rate of a spool driving motor 34 can prevent a sag of the sheet 1 and supply the sheet 1.

Also in the configuration shown in FIG. 21, a movable guide member 68 is used. If a roll supply unit is not used as a winding unit, the guide member 68 is extended to prevent the leading end of the sheet from entering the roll supply unit. If the roll supply unit is used as a winding unit, the guide member 68 is housed in the discharge guide 61, and the guide member 68 is retracted into a position at which it does not interfere with a winding operation. Further, forming the discharge guide 61 as well as the guide member 68 as a movable member can prevent these members from interfering with the operation when the roll sheet is set or the like. In this manner, the same effect as the one in the first embodiment can be produced.

Other Embodiment

In the above embodiments, descriptions have been given of the configuration of the printer using two roll supply units. However, the number of roll supply units that can be used for the printer is not limited to two. Three or more roll supply units may be used. Further, a single roll supply unit having a supply function of supplying a sheet to a printing unit and a winding function of winding up a sheet supplied from another device or the like, for example, may be used. Even in this case, like the above embodiments, using the movable guide member can lead a sheet to a desirable position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234759, filed Nov. 19, 2014, which is hereby incorporated by reference wherein in its entirety.

What is claimed is:

1. A printing apparatus comprising:

a supply unit configured to hold a plurality of rolls of a wound continuous sheet;

a printing unit configured to print an image on a sheet drawn from one of the rolls held by the supply unit;

a storage unit configured to store a sheet printed on by the printing unit; and a guiding unit configured to be capable-of-taking (a) a first position at which the sheet discharged from the printing unit is restricted to be fed toward the supply unit and is dropped within the storage unit and (b) a second position at which the sheet discharged from the printing unit is allowed to be fed toward the supply unit so that the sheet is wound as a roll.

2. The printing apparatus according to claim 1, wherein the supply unit includes a first holding unit and a second holding unit, and in a state where the guiding unit takes the second position, a sheet which is drawn from a roll held by the first holding unit, printed in the printing unit, and fed toward the supplying unit, is wound by the second holding unit.

3. The printing apparatus according to claim 2, wherein the guiding unit is capable of taking a third position at which the guiding unit does not interfere with an operation of setting a roll on the supply unit.

4. The printing apparatus according to claim 2, wherein the guiding unit has a member that is rotatably supported and is switchable between the first position and the second position by rotation.

5. The printing apparatus according to claim 1, further comprising:

a detection unit configured to detect a state of the guiding unit; and a notifying unit configured to notify a user in a case where a destination of a sheet to be discharged does not match with the state of the guiding unit detected by the detection unit.

6. The printing apparatus according to claim 5, wherein in a case where the guiding unit takes the second position so as to wind a sheet in the supply unit, if the detection unit detects that the guiding unit does not take the second position, the supply unit does not perform a winding operation of the sheet.

7. The printing apparatus according to claim 1, wherein the printing unit prints the image in an ink jet system.

8. A printing apparatus comprising:

a supply unit including a first holding unit and a second holding unit each configured to hold a roll of a wound continuous sheet;

a printing unit configured to print an image on a sheet drawn from one of the rolls held by the supply unit;

a storage unit configured to store a sheet printed on by the printing unit; and a detection unit configured to detect a sheet supplied from the supply unit toward the printing unit, wherein said printing apparatus performs at least a first mode in which a sheet drawn from the first holding unit or the second holding unit and printed in the printing unit is discharged to the storage unit, and a second mode in which a sheet drawn from the roll held by the first holding unit and printed in the printing unit is wound in the second holding unit, and wherein in the first mode, if the detection unit does not detect a sheet supplied from the first holding unit or the second holding unit, a user is notified of confirmation of the mode, and in the second mode, if the detection unit does not detect a sheet supplied from the first holding unit, a user is notified of confirmation of the mode.

9. A printing apparatus comprising:

a first holding unit and a second holding unit each configured to hold a roll of a wound continuous sheet;

a printing unit configured to print an image on a sheet supplied from one of the first and the second holding units; and a basket unit configured to store a sheet printed on by the printing unit, wherein the basket unit is configured to become (a) a first state in which the sheet supplied from any one of the first and the second holding units and printed on by the printing unit is dropped within the basket unit without being fed toward the second holding unit, and (b) a second state in which the sheet supplied from the first holding unit and printed on by the printing unit is allowed to be fed toward the second holding unit to be wound as a roll by the second holding unit.

10. The printing apparatus according to claim 9, wherein in the first state, the basket unit covers a side of the second holding unit such that the sheet printed by the printing unit is restricted to be fed toward the second holding unit.

11. The printing apparatus according to claim 9, wherein in the second state, a roll held by the first holding unit rotates for sheet supplying and a roll held by the second holding unit rotates for sheet winding.

12. The printing apparatus according to claim 9, wherein the basket unit includes a plurality of rods and a cloth member being supported by the rods to form a receiving portion for the printed sheet, and a position of at least one of the rod is changeable to become the first state or the second state.

13. The printing apparatus according to claim 9, wherein the printing unit prints the image in an ink jet system.

* * * * *